US006559393B2

(12) United States Patent
Nishikawa

(10) Patent No.: US 6,559,393 B2
(45) Date of Patent: May 6, 2003

(54) SWITCH HAVING A SEESAW TYPE MOVABLE CONTACT BLADE

(75) Inventor: Kikuyoshi Nishikawa, Yokohama (JP)

(73) Assignee: Sagami Electric Company, Kanagawa (JP)

( * ) Notice: Subject to any disclaimer, the term of this patent is extended or adjusted under 35 U.S.C. 154(b) by 0 days.

(21) Appl. No.: 10/099,489

(22) Filed: Mar. 13, 2002

(65) Prior Publication Data

US 2002/0134653 A1 Sep. 26, 2002

(30) Foreign Application Priority Data

Mar. 21, 2001 (JP) ..... 2001-080896

(51) Int. Cl.[7] ..... H01H 19/00
(52) U.S. Cl. ..... 200/6 R; 200/558
(58) Field of Search ..... 200/6 B, 6 BB, 200/6 C, 16 C, 16 D, 6 R, 553, 557–559, 405, 407, 424, 428–439, 449, 447, 339, 558

(56) References Cited

U.S. PATENT DOCUMENTS 4,389,552 A * 6/1983 Sorenson ..... 200/241
4,814,554 A * 3/1989 Magiera ..... 200/339
5,041,706 A * 8/1991 Osika et al. ..... 200/295
6,175,090 B1 * 1/2001 Blossfeld ..... 200/401

* cited by examiner

*Primary Examiner*—Elvin Enad
*Assistant Examiner*—Lisa N. Klaus
(74) *Attorney, Agent, or Firm*—David N. Lathrop, Esq.; Gallagher & Lathrop

(57) ABSTRACT

A support plate having a top end edge defining a central convex portion which is the highest in the center thereof is vertically secured in the case to the bottom panel of the case, and a movable contact blade is supported on the top end edge of the support plate for rotating movement. Attached to the movable contact blade at one end thereof are two movable contacts spaced apart in the direction of the pivot axis of the blade. Two fixed contact blades are disposed on the bottom panel and each has a fixed contact attached thereto in opposition to a corresponding one of the movable contacts with the end portion of each fixed contact blade extending out through the bottom panel to define a terminal. Two serial switches are constituted by means of the movable contact blade between the two terminals, rotation of a rotatable actuator causes two sliding protrusions of a driving piece to slide across the upper surface of the movable contact blade, whereby the two serially connected switches are simultaneously turned on and off.

17 Claims, 24 Drawing Sheets

SWITCH HAVING A SEESAW TYPE MOVABLE CONTACT BLADE

BACKGROUND OF THE INVENTION

This invention relates to a switch having a seesaw type movable contact blade.

FIGS. 1A and 1B show an example of the prior art switch having a movable contact blade configured to be moved through a seesaw motion in a vertical cross-sectional view taken parallel to the major side of the switch and in a vertical cross-sectional view taken parallel to the minor side, respectively. A metallic support plate 60 is passed vertically through and secured to the bottom panel 12 of the box-like case 10 made of electrically insulating plastic material generally in the center thereof. The support plate 60 has upstanding guide projections $\mathbf{61}_1$ and $\mathbf{61}_2$ extending from the top end edge thereof at the opposite sides between which a movable contact blade 50 is swingably mounted on the top end edge. The top end edge of the support plate 60 serves as a fulcrum for the swinging movement of the movable contact blade 50 while the lower end portion of the support plate 60 extending outside of the bottom panel 12 defines a movable contact blade terminal 6T which is electrically connected by contact with the movable contact blade 50.

Attached to the undersurface of the movable contact blade 50 adjacent one end thereof is a movable contact 50C. An inverted L-shaped fixed contact blade 70 is disposed on the bottom panel 12 of the case such that the upper horizontal leg 72 of the fixed contact blade 70 is in opposition to the undersurface of the movable contact blade 50 while the vertical leg of the blade extends as a fixed contact blade terminal 7T downwardly out through the bottom panel 12. The upper horizontal leg 72 of the fixed contact blade 70 has a fixed contact 70C attached thereto in opposition to the movable contact 50C.

A tumbler type actuator 40 is disposed over the movable contact blade 50 so as to close the top opening 10A of the case 10. The actuator 40 has pivot studs 47 extending from the opposite side walls thereof which are received in bearing holes 16 formed in the opposite side walls 11 of the case 10. The actuator 40 further has an integral columnar portion 42 extending downwardly from the undersurface of the tumbler body in the center thereof The columnar portion 42 has a spring housing bore 42A formed therein in which a coil spring 45 is accommodated. A plunger 43 has its upper end portion inserted in the housing bore 42A and engaged by the coil spring 45 to be downwardly biased so that the lower end of the plunger 43 is always urged to be in sliding engagement with the upper surface of the movable contact blade 50 by the biasing force of the coil spring 45.

In FIG. 1A, the tumbler type actuator 40 is illustrated as being depressed in its switch-off position in which the lower end of the plunger 43 presses down on the upper surface of the movable contact blade 50 on the side of the support plate 60 opposite from the movable contact 50C to stably hold the movable contact 50C opened from the fixed contact 70C so that there is no electrical continuity between the terminals 6T and 7T. When the actuator 40 is pressed toward its switch-on position, it is turned clockwise as viewed in the drawing about the studs 47 so that the lower end of the plunger 43 is slidingly moved up the upper surface of the movable contact blade 50 toward and beyond the upper end of the support plate 60 against the spring force of the coil spring 45 to go over to the portion of the upper surface of the blade on the side of the movable contact 50C whereupon the movable contact blade 50 is swung to bring the movable contact 50C into abutment with the fixed contact 70C to thereby stably hold the switch in the on-position. As a result, the terminals 6T and 7T are kept in electrical continuity.

While in this prior art switch the contact is established between the undersurface of the movable contact blade 50 and the straight top end edge of the support plate 60, a complete line contact is not realized but there are actually a plurality of point contacts. Further, the positions of the contact points will change with the swinging movement of the movable contact blade 50 and may also move due to a mechanical shock or vibration, so that the electrical stability of the switch has not been satisfactory. In addition, since substantially all of the voltage across the terminals 6T and 7T is applied between the contacts 50C and 70C, the switch had the disadvantage that it was attended with an expedited wearing out of the contacts 50C and 70C due to discharge sparks during the making and breaking of the contacts.

SUMMARY OF THE INVENTION

It is an object of this invention is to provide a switch with a seesaw type movable contact blade which has a high withstandingness to voltage and which ensures a reduced wearing out of the contacts due to sparks occurring during the switching of the switch and is electrically stable.

The switch according to this invention comprises:

- a box-like case having a bottom panel of an insulator and an opening in the top thereof;
- a support plate secured to and extending vertically upwardly from the bottom panel and terminating in a top end edge defining a central convex portion which is the highest in the center thereof;
- a movable contact blade formed of a generally quadrilateral metallic plate supported on the top end edge of the support plate for rotating movement about the top end edge defining a pivot axis and having attached thereon two movable contacts spaced apart in the direction of the pivot axis adjacent one end of the blade;
- two fixed contact blades affixed at one end to the bottom panel and each having a fixed contact attached thereto adjacent the one end in opposition to a corresponding one of the movable contacts with the other end portion of each fixed contact blade extending out through the bottom panel to define a terminal;
- a driving means having two sliding protrusions pressing on the upper surface of the movable contact blade and slidable in a direction perpendicular to the direction of the pivot axis;
- coil spring means having a biasing force to urge the driving means toward the movable contact blade;
- a rotatable actuator having a spring housing bore formed in the lower end portion in which the coil spring means is accommodated and including a columnar portion adapted to hold the driving means retractably in abutment with the movable contact blade as the driving means is slidingly moved on the movable contact blade; and
- a cover means mounted so as to close the top opening of the case and having an aperture formed therethrough in the center thereof for rotatably holding the actuator which is inserted through the aperture;
- whereby rotation of the actuator selectively establishes and break electrical continuity between the terminals between the two fixed contacts.

DETAILED DESCRIPTION OF THE PREFERRED EMBODIMENTS

Figure 1A:
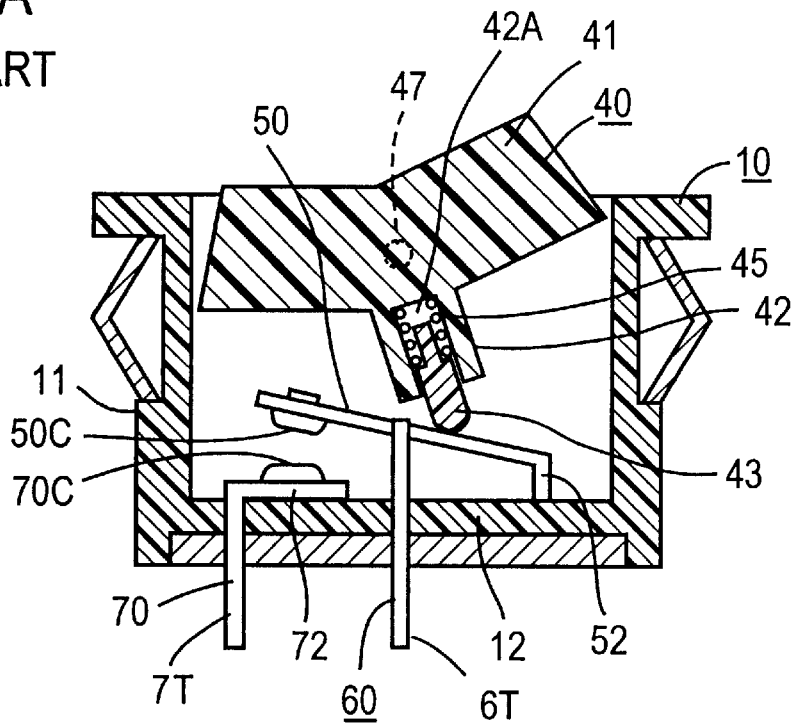
FIG. 1A PRIOR ART
FIG. 1A is a vertical cross-sectional view of the prior art switch.
Figure 1B:
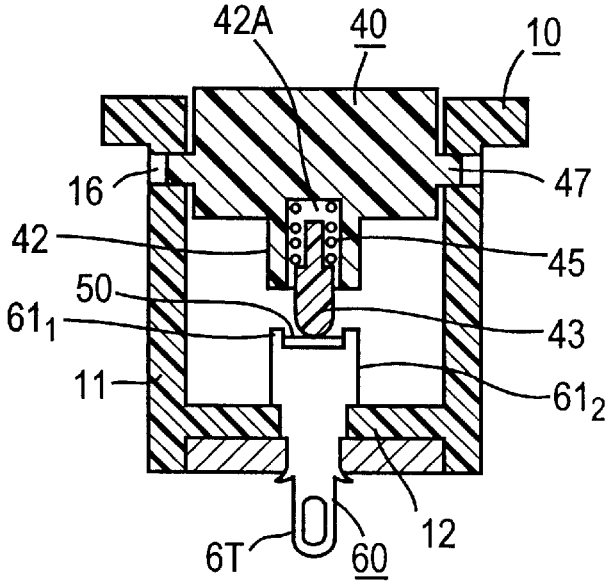
FIG. 1B PRIOR ART
FIG. 1B is a vertical cross-sectional view taken perpendicularly to the vertical cross-sectional view of FIG. 1A.
Figure 2A:
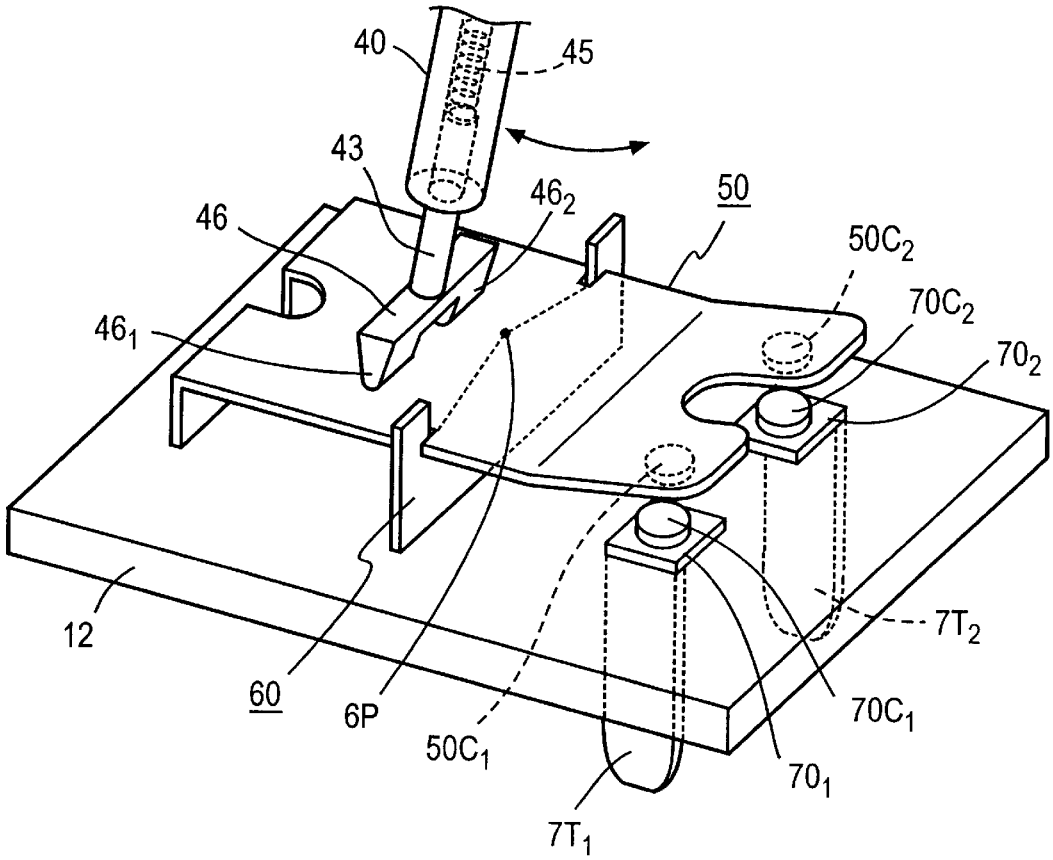
FIG. 2A is a perspective view illustrating the fundamental construction of the switch according to this invention.

FIG. 2A shows only the principal parts of the switch in a schematical form in order to illustrate the fundamental construction of the switch according to this invention. In this invention, a movable contact blade 50 has attached thereon two movable contacts $\mathbf{50}C_1$, $\mathbf{50}C_2$ spaced apart in the direction of the pivot axis of the blade adjacent one end of the blade. Disposed on a bottom panel 12 are two fixed contact blades $\mathbf{70}_1$, $\mathbf{70}_2$ having fixed contacts $\mathbf{70}C_1$, $\mathbf{70}C_2$ attached thereon in opposition to the corresponding movable contacts $\mathbf{50}C_1$, $\mathbf{50}C_2$ with the terminals $7T_1$, $7T_2$ of the fixed contact blade extending out through the bottom panel 12. The movable contact blade 50 is supported on the undersurface generally in the center thereof by a central apex or crown 6P of a support plate 60. As is thus appreciated, the undersurface of the movable contact blade 50 is in contact with the central apex 6P of the support plate 60 at substantially one point.

An actuator or a control knob 40 has mounted therein a plunger 43 having a driving piece 46 attached thereto at the lower end. The driving piece 46 has two sliding protrusions $\mathbf{46}_1$, $\mathbf{46}_2$ of equal length juxtaposed in the direction of the pivot axis of the movable contact blade 50, the lower ends of which sliding protrusions $\mathbf{46}_1$, $\mathbf{46}_2$ are adapted to slide in a direction perpendicular to the direction of the pivot axis of the movable contact blade 50 and along two parallel lines oppositely equally spaced from the central apex 6P. It will thus be appreciated that the pivot axis of the movable contact blade 50 is always maintained parallel to the plane of the bottom panel 12 despite the fact that the movable contact blade 50 is supported by the central apex or crown 6P of the support plate 60.

In FIG. 2A, the lower ends of the sliding protrusions $\mathbf{46}_1$, $\mathbf{46}_2$ press on the movable contact blade 50 on the side opposite from the movable contacts $\mathbf{50}C_1$, $\mathbf{50}C_2$ while the end portion of the movable contact blade 50 on the side opposite from the movable contacts $\mathbf{50}C_1$, $\mathbf{50}C_2$ is in abutment with the bottom panel 12 whereby the movable contact blade 50 is held in a stable manner. At this time, the movable contacts $\mathbf{50}C_1$, $\mathbf{50}C_2$ and the fixed contacts $\mathbf{70}C_1$, $\mathbf{70}C_2$ are disengaged from each other while the two terminals $7T_1$, $7T_2$ are in the non-conduction state, that is, the switch-off position. When the lower ends of the sliding protrusions $\mathbf{46}_1$, $\mathbf{46}_2$ are slidingly moved along the movable contact blade passing the opposite sides of the central apex 6P of the support plate 60 to go over the upper end of the support plate 60 to the portion of the movable contact blade on the same side as the movable contacts $\mathbf{50}C_1$, $\mathbf{50}C_2$, the movable contact blade 50 is rotated clockwise to bring the movable contacts $\mathbf{50}C_1$, $\mathbf{50}C_2$ into contact with the fixed contacts $\mathbf{70}C_1$, $\mathbf{70}C_2$ to stably hold the switch in that state. In this state, the two terminals $7T_1$, $7T_2$ are in the conduction state, that is, the switch-on position.

Figure 2B:
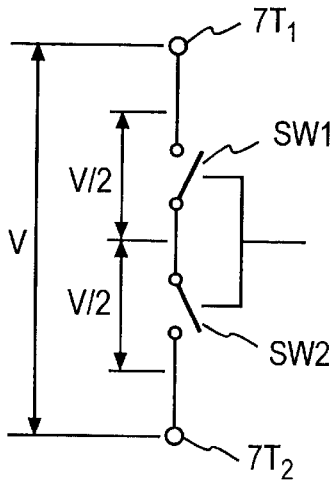
FIG. 2B is a diagram illustrating the equivalent circuit of the switch according to this invention.

The switch illustrated in FIG. 2A is configured to turn on and off two serially connected switches SW1, SW2 simultaneously in a gang as seen from the equivalent circuit in FIG. 2B. Consequently, the voltage V applied across the two terminals $7T_1$, and $7T_2$ is divided in two, V/2 being applied to each of the switches SW1, SW2, so that the switch according to this invention has a correspondingly enhanced withstandingness to voltage. In addition, because of the voltage applied to the switches SW1, SW2 being halved to V/2, the wearing out of the contacts $50C_1$, $50C_2$ and $70C_1$, $70C_2$ due to sparks occurring during the turning on and off is reduced. Moreover, since the support plate 60 is not used as an electrical terminal leading out of the movable contact blade 50, the condition of contact between the support plate 60 and the movable contact blade 50 has no bearing on the stability of the switch, leading to no cause for instability of the switch as is the case with the prior art switch.

First Embodiment:

FIGS. 3–8 show a first embodiment of the switch according to this invention to which the principle illustrated in FIGS. 2A, 2B is applied. In this embodiment, a metallic cover 20 (see also FIG. 4) having an inverted U-shaped cross-section is disposed over the insulating box-like case 10 to close the top opening and cover the upper half portions of the opposite sides of the insulating box-like case 10. A cylindrical rotator holding section 30 has a thin-walled rim portion 33 at its lower end which is fitted in an aperture 24 formed through the cover 20 in the center thereof with the outer extension of the rim portion 33 being folded radially outwardly to be crimped to the cover 20. The rotator holding section 30 has threads formed in its outer periphery for threadedly attaching the switch to a device with which the switch is to be used and thus doubles as a switch mounting portion for attaching the switch to a device.

The rotator holding section 30 defines therein a rotator housing cavity 31 having an inner diameter decreasing toward the top and an opening 32 communicating with the rotator housing cavity 31 and having an inner diameter increasing toward the top. An actuator 40 in the form of a toggle lever comprises a lower, generally half portion formed as a columnar portion 42 defining therein a spring housing bore 42A extending from the lower end thereof concentrically with the central axis of the actuator. The lower part of the columnar portion 42 comprises an enlarged-diameter, generally spherical portion 42B. The spherical portion 42B is rotatably received in the rotator housing cavity 31 and acts as a rotary shaft. The upper portion of the actuator 40 extending out through the opening 32 acts as a handle portion 41.

Accommodated in the spring housing bore 42A is a coil spring 45 the lower end of which engages the upper end of a plunger 43 inserted in the housing bore 42A to bias the plunger 43 by the coil spring 45 so that the lower end of the plunger 43 is always extended from the columnar portion 42. The plunger 43 has attached thereto at the lower end thereof a driving piece 46 having two sliding protrusions $46_1$, $46_2$. The sliding protrusions $46_1$, $46_2$ are arranged in the direction of the pivot axis of the movable contact blade 50 and are slidingly movable in a direction perpendicular to the direction of the pivot axis of the movable contact blade 50 along two parallel lines oppositely equally spaced from the central apex 6P of a support plate 60 at the upper end edge thereof.

Figure 4:
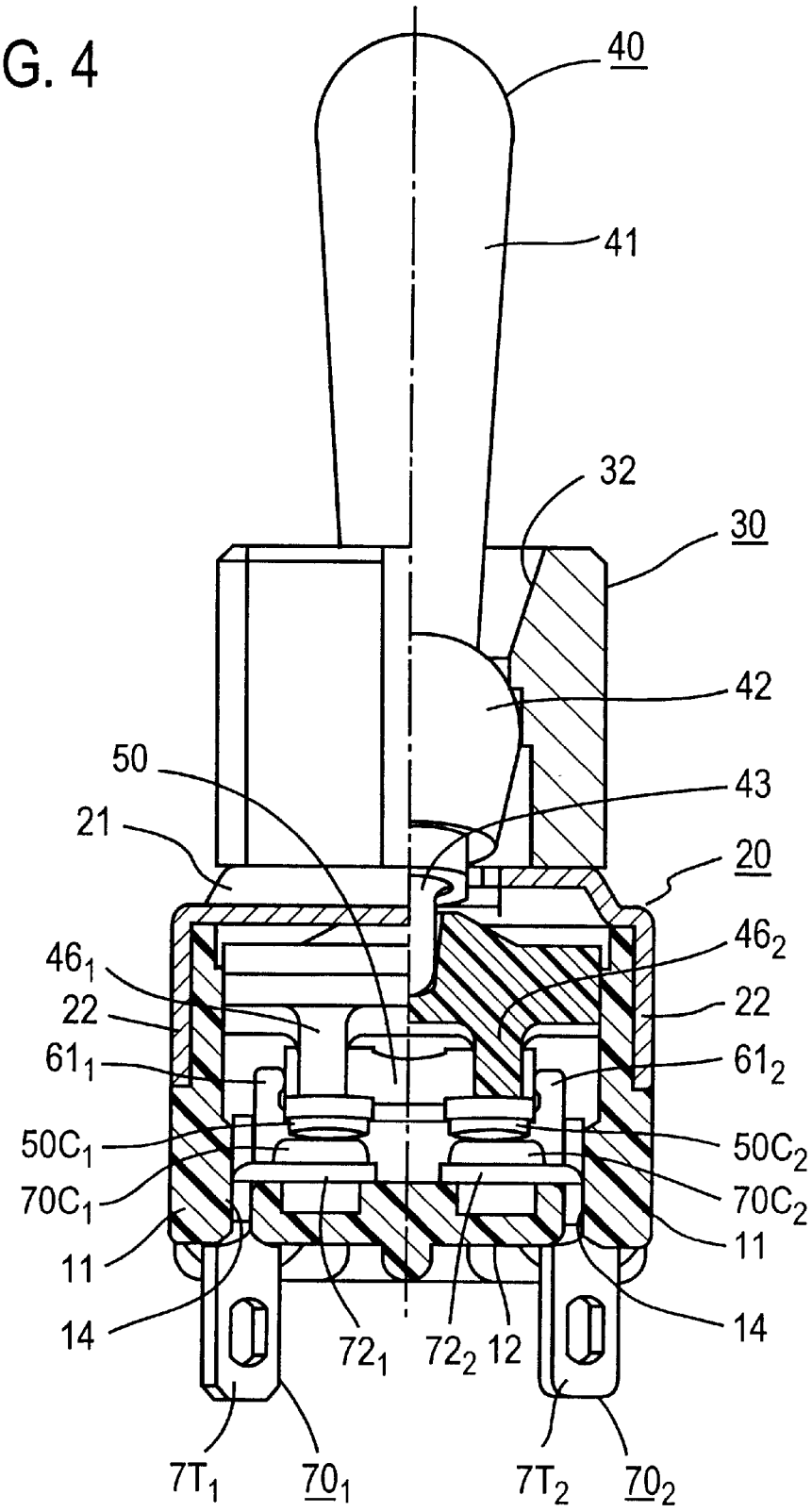
FIG. 4 is a vertical view, partly in cross-section, of the first embodiment taken parallel to the minor side of the switch.
Figure 5:
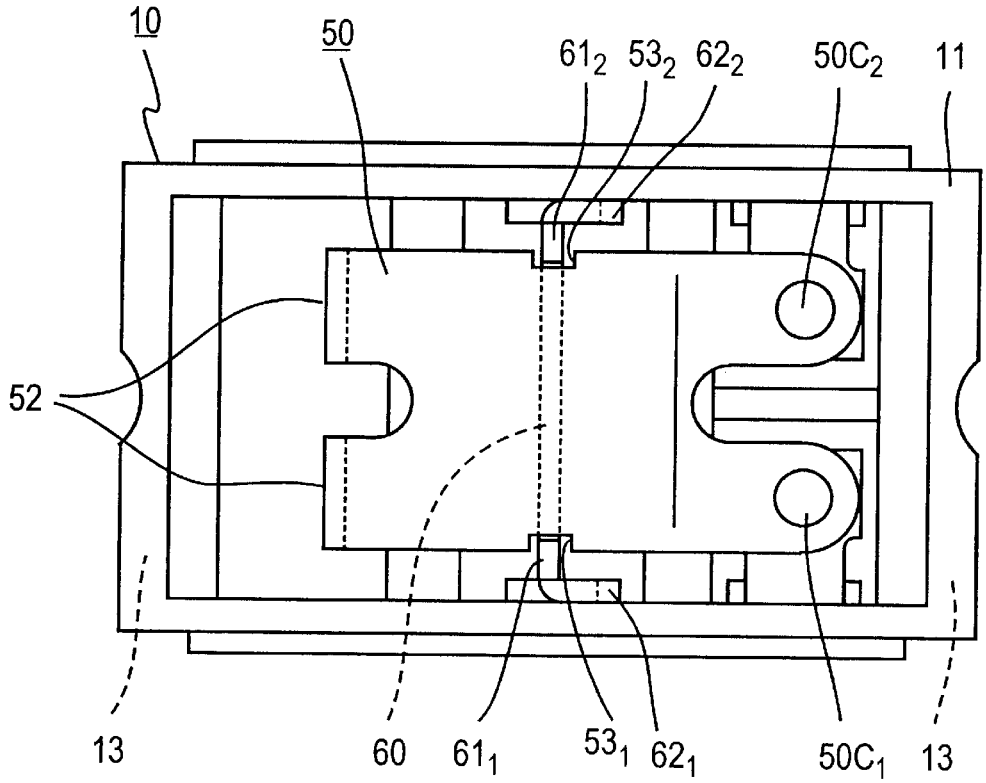
FIG. 5 is a plan view of the first embodiment with the cover 20 removed therefrom.

The box-like case 10 is generally rectangular as viewed from the top as shown in FIG. 5. The opposite major side walls of the case have their lower halves increased in thickness so as to protrude outwardly as shown in FIGS. 4 and 5.

Figure 6:
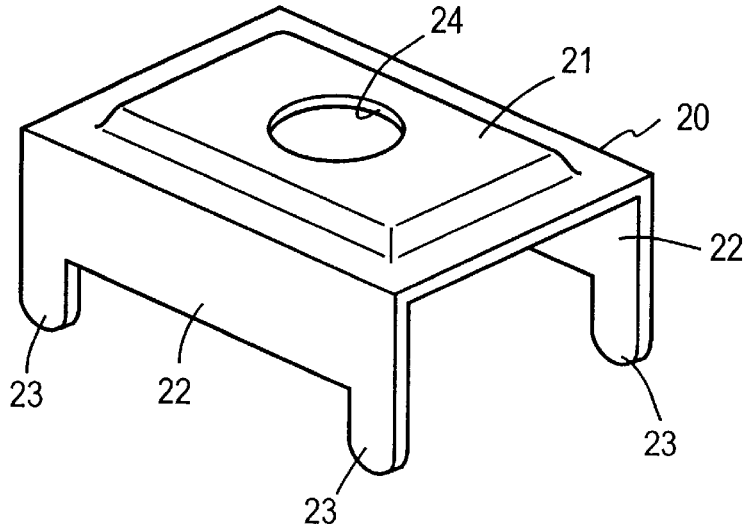
FIG. 6 is a perspective view of the cover 20.
Figure 7A:
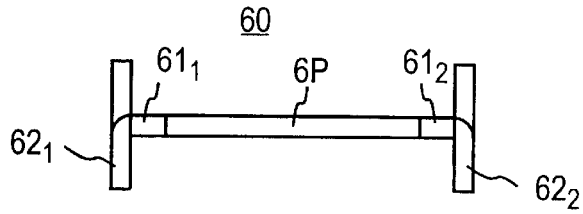
FIG. 7A is a plan view of the support plate 60.
Figure 7B:
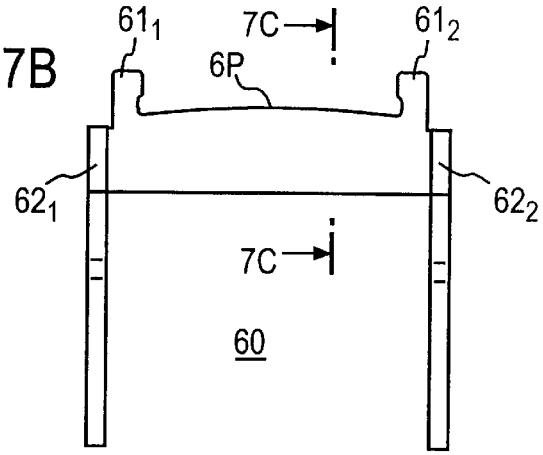
FIG. 7B is a front view of the support plate 60.
Figure 7C:
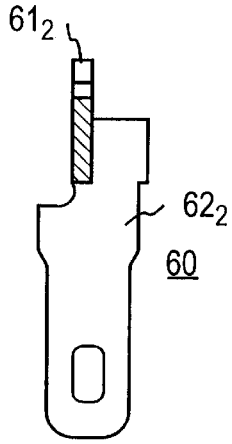
FIG. 7C is a cross-sectional view of the support plate 60 taken along the line 7C—7C in FIG. 7B.

As shown in FIG. 6, the cover 20 comprises a generally rectangular top panel section 21 and side panel sections 22 extending perpendicularly downwardly from the opposite major sides of the top panel section. The side panel sections 22 are mounted to the case 10 so as to cover the upper half portions of the opposite major side walls of the case 10 as shown in FIG. 4. The top panel section 21 of the cover 20 is formed in its center with an opening 24. Each of the side panel sections 22 has tabs 23 depending downwardly therefrom at its opposite ends.

Figure 3:
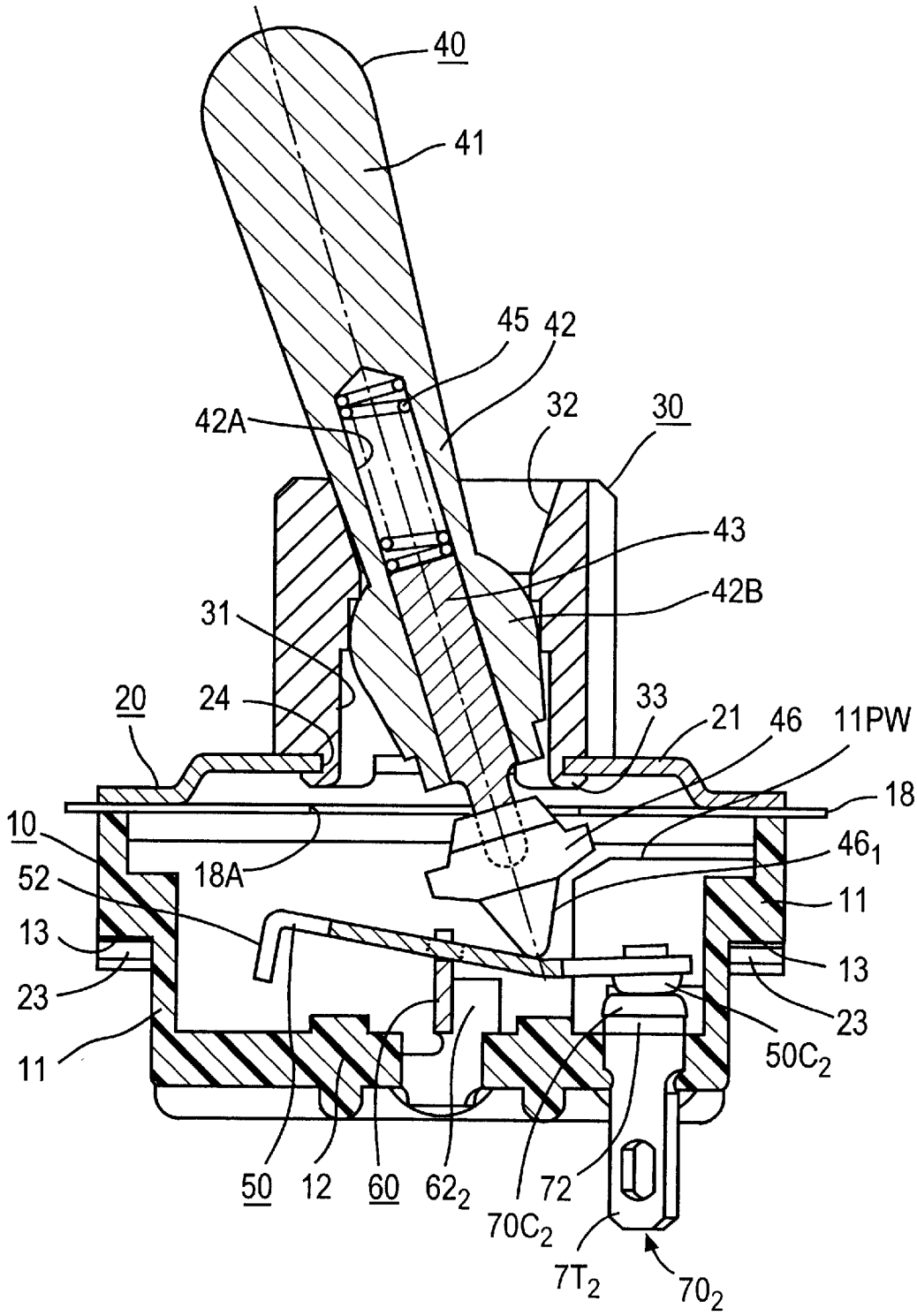
FIG. 3 is a vertical cross-sectional view of a first embodiment of the switch according to this invention taken parallel to the major side of the switch.

As shown in FIGS. 3 and 5, the generally rectangular support plate 60 is vertically fixed to the bottom panel 12 of the case 10 generally in the center thereof. As shown in a plan view, a front view and a cross-sectional view taken on the line 7C—7C in FIGS. 7A, 7B and 7C, respectively, the support plate 60 has guide projections $61_1$, $61_2$ extending from its opposite lateral sides, and the upper end edge of the support plate extending between the guide projections $61_1$ and $61_2$ is formed in a convex shape which is the highest in the center 6P. The height of the apex 6P may be about 0.5–1.0 mm higher than that of the opposite lateral sides of the support plate and the guide projections $61_1$, $61_2$ are further higher by more than the thickness of the movable contact blade 50 than the apex, whereby the fulcrum for rotation of the movable contact blade 50 as will be described later is set at substantially one point. It should be understood that the shape of the upper end edge of the support plate 60 may be arcuate or may be defined by two sides of a triangle, only if it is made the highest in the center. In addition, the upper end edge of the support plate 60 may be in the shape of a wedge in cross-section having a progressively decreasing thickness toward the top end in order to minimize the change in the starting point of rotation of the swingable contact blade 50 when it begins to be rotated.

The support plate 60 has mounting plate sections $62_1$, $62_2$ extending perpendicularly and downwardly from its opposite lateral sides. The mounting plate sections $62_1$, $62_2$ are not utilized as terminals but are made to extend downwardly through the bottom panel 12 to secure the support plate 60 to the bottom panel by twisting and deforming the outer protruding ends of the mounting plate sections, whereafter the protruding ends are cut off, as shown in FIG. 3. Since the support plate 60 does not electrically contribute to the switching circuit, it may be formed of an insulating material and be secured to the bottom panel 12 by press-fitting the mounting plate sections $62_1$, $62_2$ in slots (not shown) formed in the bottom panel.

Figure 8A:
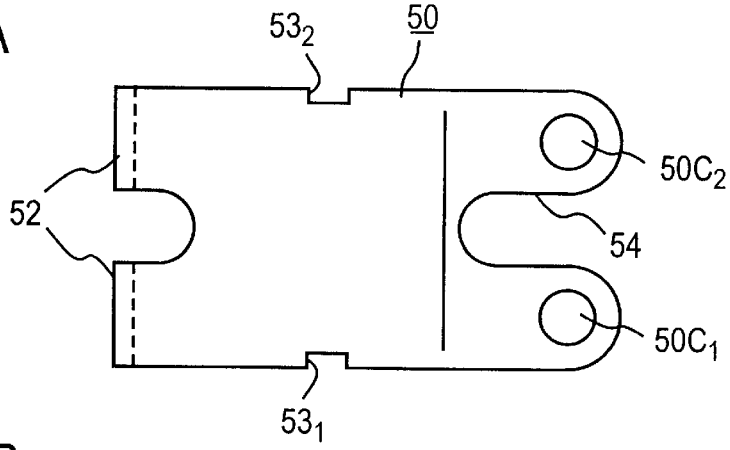
FIG. 8A is a plan view of the movable contact blade 50.
Figure 8B:
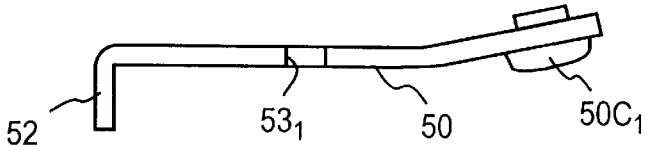
FIG. 8B is a side view of the support plate 60.

As shown in a plan view and a front view in FIGS. 8A and 8B, respectively, the movable contact blade 50 is formed of a generally rectangular metallic sheet and has movable contacts $50C_1$, $50C_2$ attached thereto at opposite corners along one minor side and a cutout 54 formed extending from the center of the one minor side between the movable contacts $50C_1$, and $50C_2$ inwardly toward the other minor side. As shown in FIGS. 3 and 5, a partition wall 11 PW extending inwardly from the bottom panel 12 and the one minor side wall 11 of the case 10 is inserted loosely in the cutout 54 without contacting the surrounding wall of the cutout to thereby increase the creeping distance between the movable contacts $50C_1$, and $50C_2$, whereby discharge is prevented from occurring even if an abnormally high voltage is applied between the terminals $7T_1$, and $7T_2$ when the switch is in the OFF position, which contributes to enhancing the withstandingness to voltage of the switch. The movable contact blade 50 further has engagement recesses 531, 532 formed generally in the middle of the opposite major sides for engageably receiving the inner edges of the corresponding guide projections $61_1$, $61_2$ of the support plate 60 whereby the movable contact blade 50 is rotatably supported between the guide projections $61_1$ and $61_2$. The end portion of the movable contact blade 50 opposite from the movable contacts $50C_1$, $50C_2$ is folded toward the bottom panel 12 to define a stop portion 52 which serves to limit the range of rotation of the movable contact blade 50.

As shown in FIGS. 3 and 4, mounted in the bottom panel 12 are inverted L-shaped fixed contact blades 701, 702 having mounting plates 721, 722, respectively to which fixed contacts $70C_1$, $70C_2$ are attached below and in opposition to the corresponding movable contacts $50C_1$, $50C_2$. The vertical legs of the fixed contact blades 701, 702 extend through the bottom panel 12 to define terminals $7T_1$, $7T_2$, respectively, with the lower protruded extensions being 45° twisted to prevent withdrawal to thereby secure the fixed contact blades $70_1$, $70_2$ in place.

In order to assemble the switch according to this invention, first the coil spring 45 is inserted in the spring housing bore 42A of the actuator 40, followed by inserting in the bore the plunger 43 having the driving piece 46 fixed on its tip. An insulation sheet 18 having an aperture 18A formed in its center is placed over the open top of the case 10 onto the top ends of the side walls 11, and the driving piece 46 mounted to the actuator 40 is inserted through the aperture 18A into the interior of the case 10 with the sliding protrusions $46_1$, $46_2$ held in contact with the upper surface of the movable contact blade 50. The cover 20 is then placed while fitting the rotator holding section 30 over the actuator 40 from its per end, with the insulation sheet 18 sandwiched between the cover 20 and the top ends of the side walls 11. The tabs 23 at the four lower end corners of the opposite side panel sections 22 of the cover 20 are then bent into engagement with the steps 13 formed on the side walls 11 of the case 10 to fix the cover 20 in place. The insulation sheet 18 is intended to prevent the ingress of foreign matters into the interior of the case 10, but may be omitted.

In the first embodiment as described hereinabove, when the toggle lever 41 is inverted (turned in the reverse direction), the lower ends of the two sliding protrusions $46_1$, $46_2$ of the driving piece 46 are simultaneously slid across the upper surface of the movable contact blade 50 to go over the support plate 60 whereupon the movable contact blade 50 is inverted (swung in the reverse direction), whereby the simultaneous contact making (ON) and simultaneous contact breaking (OFF) between the two movable contacts $50C_1$, $50C_2$ and the two fixed contacts $70C_1$, $70C_2$ may be effected.

Figure 9:
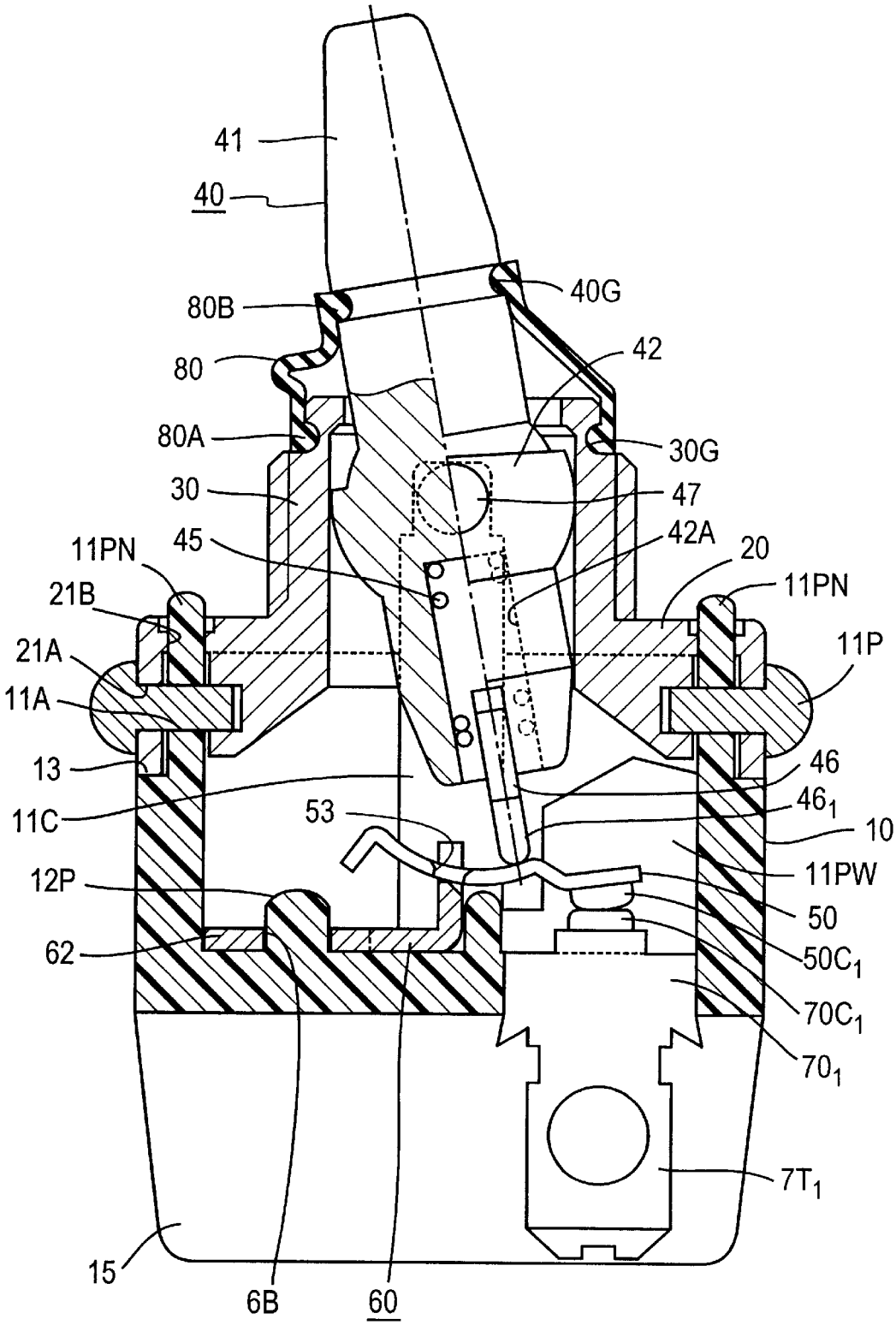
FIG. 9 is a vertical cross-sectional view of a second embodiment of the switch according to this invention taken parallel to the major side of the switch.
Figure 10:
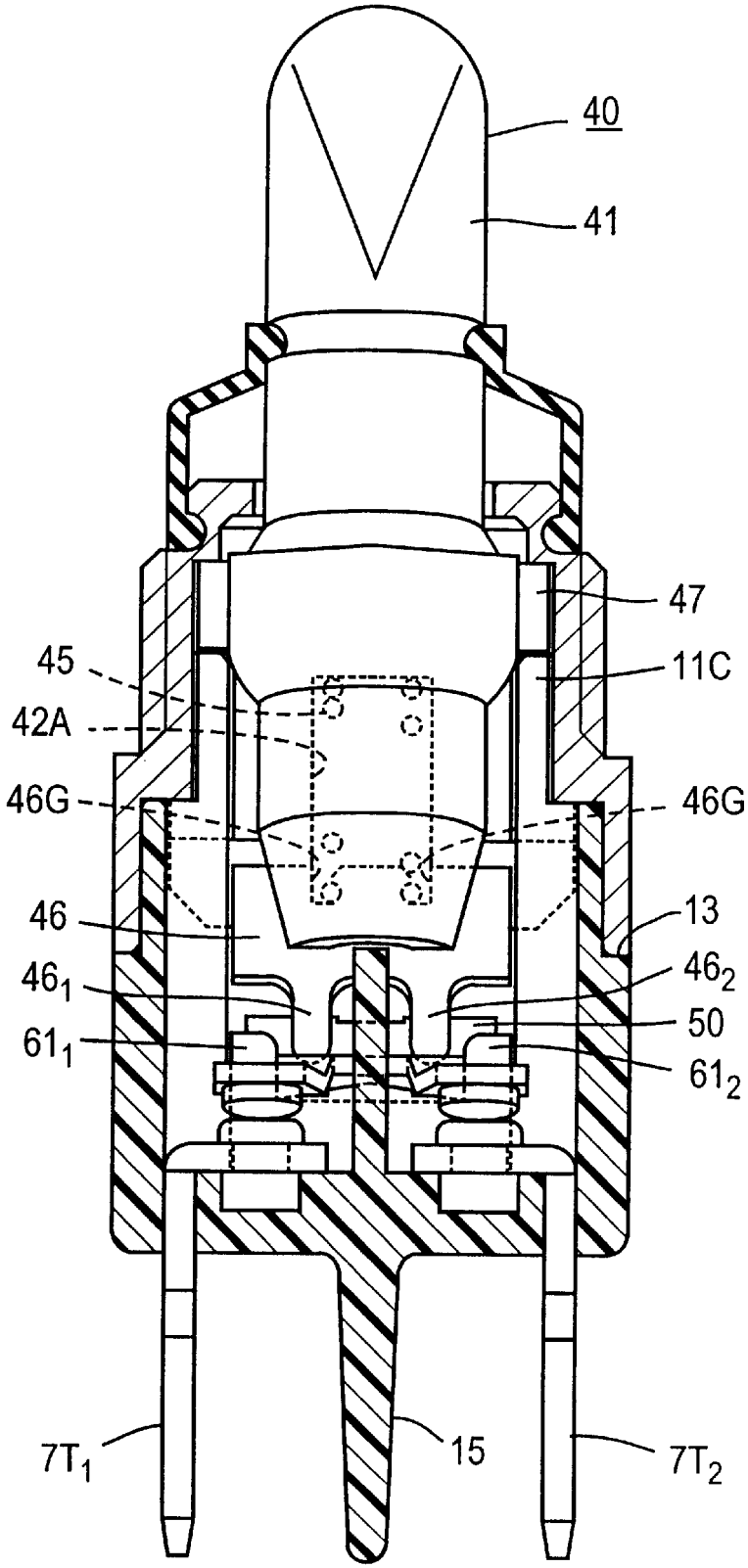
FIG. 10 is a vertical cross-sectional view of the second embodiment taken parallel to the minor side of the switch.
Figure 11:
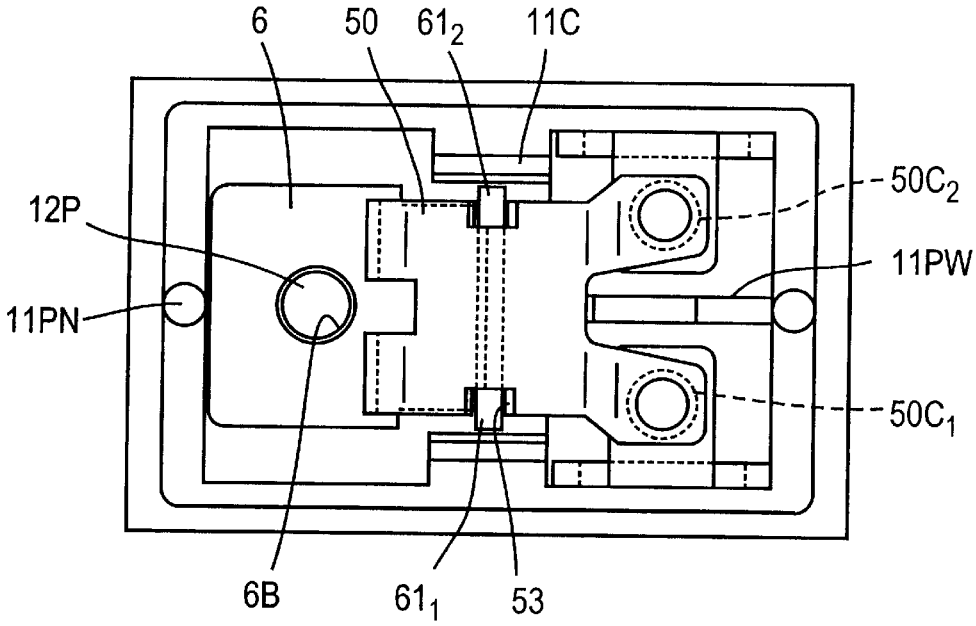
FIG. 11 is a plan view of the second embodiment with the cover 20 removed therefrom.

Second Embodiment:

FIGS. 9, 10 and 11 show the toggle type switch according to a second embodiment of this invention in a vertical cross-sectional view taken parallel to the major side of the switch, in a vertical cross-sectional view taken parallel to the minor side and in a plan view, respectively. The switch according to the second embodiment is similar to that of the first embodiment in that it likewise includes two fixed contact blades $70_1$, $70_2$ and a support plate 60 disposed on the bottom panel 12 of the case 10, a movable contact blade 50 rotatably supported on the support plate 60, and a driving piece 46 having two sliding protrusions $46_1$, $46_2$ for driving the movable contact blade 50, all of which operate on the principle similar to that described with reference to FIGS. 2A, 2B. The second embodiment is mainly distinguished from the first embodiment in the following points:

(1) The cover 20 for the case 10 mid the rotator holding section 30 are integrally formed of the same material.

(2) The actuator 40 is provided with rotary studs or trunnions 47 and the rotator housing cavity 31 is formed with bearing recesses 31GB for receiving the rotary studs 47.

(3) The plunger is in the form of a plate and doubles as a driving piece 46.

(4) A waterproof cap 80 made of rubber is provided to prevent the ingress of dust and water through between the rotator holding section 30 and the actuator 40.

The case 10 which is generally rectangular as viewed in horizontal cross-section has four side walls, the outer wall surfaces of the upper halves of which are recessed inwardly of the outer wall surfaces of the lower halves thereof to define steps 13 between the upper and lower halves of the side walls. The opposite major side walls 11 of the case 10 have post portions 11C formed integrally with the inner wall surfaces in the center thereof and vertically extending therealong and upwardly beyond the top ends of the walls 11. In addition, the opposite minor side walls of the case 10 have engagement positioning pins 11PN formed integrally with the top ends in the middle thereof and extending upwardly therefrom.

One of the minor side walls has a partition wall 11PW formed integrally with the inner surface thereof and extending therefrom inwardly toward the center of the case 10 parallel to the major side walls. Disposed on the two regions of the bottom panel 12 partitioned by the partition wall 11PW are two fixed contact blades 701, 702, respectively, the terminal portions of which extend out through the bottom panel 12 to define two fixed contact terminals $7T_1$, $7T_2$. An external partition wall 15 is formed integrally with and extends vertically downwardly from the undersurface of the bottom panel 12 so as to separate the two fixed contact terminals $7T_1$, $7T_2$ from each other in the middle therebetween.

Figure 12A:
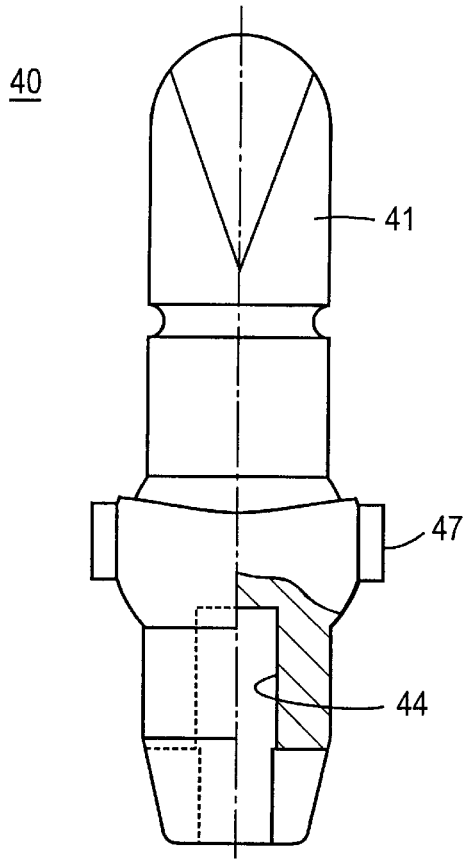
FIG. 12A is a front view of the actuator 40.
Figure 12B:
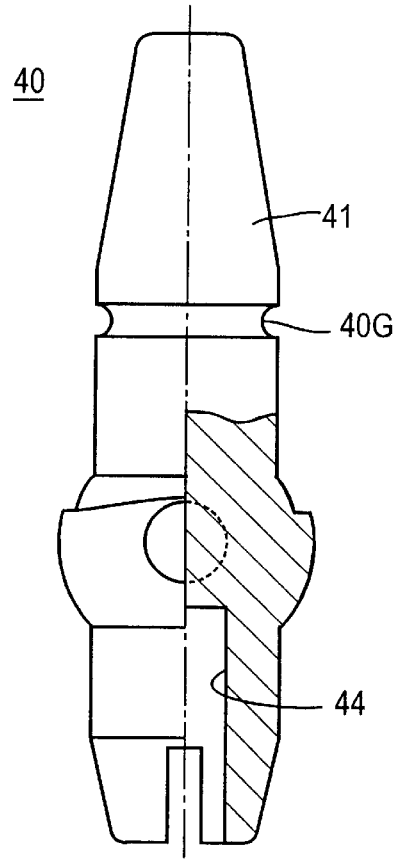
FIG. 12B is a side view of the actuator 40.
Figure 12C:
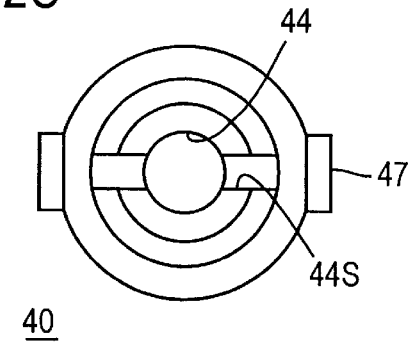
FIG. 12C is a bottom view of the actuator 40.

The combination plunger and driving piece 46 is formed in the shape of a generally rectangular plate, and has an engagement groove 46G formed in one side surface in the center thereof for engaging with one end of the coil spring 45 as shown in broken lines in FIG. 10 and two spaced apart sliding protrusions 461, 462 formed integrally with and extending from the opposed side. As shown in a side view partly in cross-section, a 90° rotated side view partly in cross-section and a bottom view, respectively, in FIGS. 12A, 12B and 12C, the actuator 40 has a spring housing bore 42A and a slide slot 44S formed in the lower end portion thereof, the spring housing bore 42A extending from the lower end of the actuator in the center thereof concentrically with the central axis of the actuator and the slide slot 44S intersecting the bore 42A diametrically thereof and extending from the lower end of the actuator along the central axis of the actuator short of the bottom of the bore 42A (that is, the slide slot 44S is shallower than the bore 42A). The coil spring 45 with its lower end connected with the engagement groove 46G in the plate-like driving piece 46 (see FIG. 10) is accommodated in the spring housing bore 42A while the plate-like driving piece 46 is mounted in the slide slot 44S.

Figure 13:
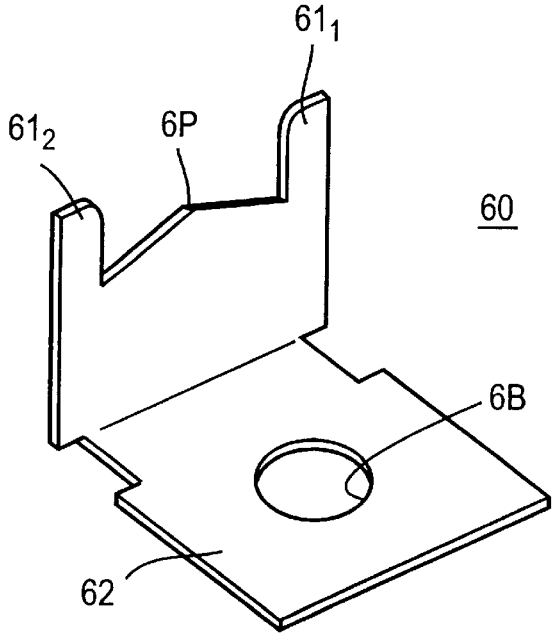
FIG. 13 is a perspective view of the support plate 60.

In this embodiment, the support plate 60 is in the shape of L as shown in FIG. 13, and the leg thereof comprises a mounting plate section 62 having a mounting aperture 6B formed in the center thereof. As in the first embodiment, the support plate 60 has an apex or crown 6P formed on the upper end edge in the center thereof and guide projections $61_1$ and $61_2$ extending upwardly from the top end edge at the opposite sides thereof. As shown in FIGS. 9 and 11, a boss 12P formed integrally with and upstanding from the bottom panel 12 of the case is press-fitted in the mounting aperture 6B of the mounting plate section 62 of the L-shaped support plate 60 to fix the support plate 60 in place.

Figure 14A:
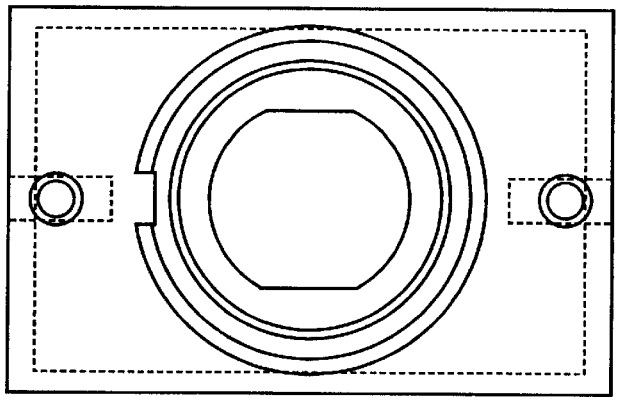
FIG. 14A is a plan view of the cover 20.
Figure 14B:
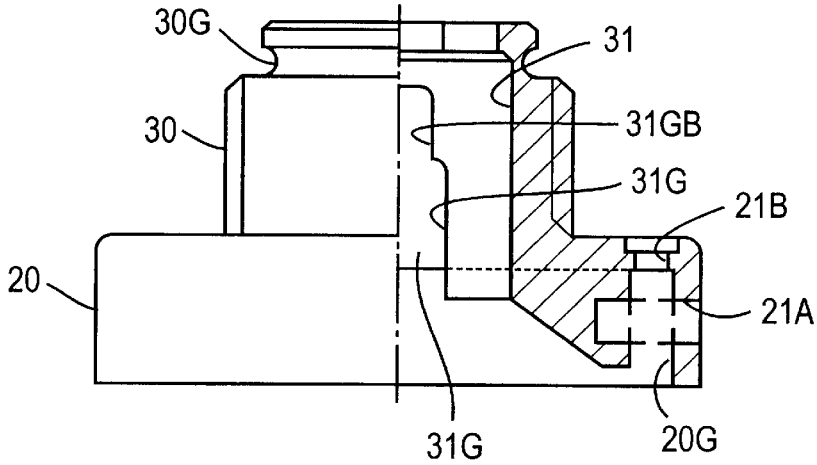
FIG. 14B is a front view, partly in cross-section, of the cover 20.
Figure 14C:
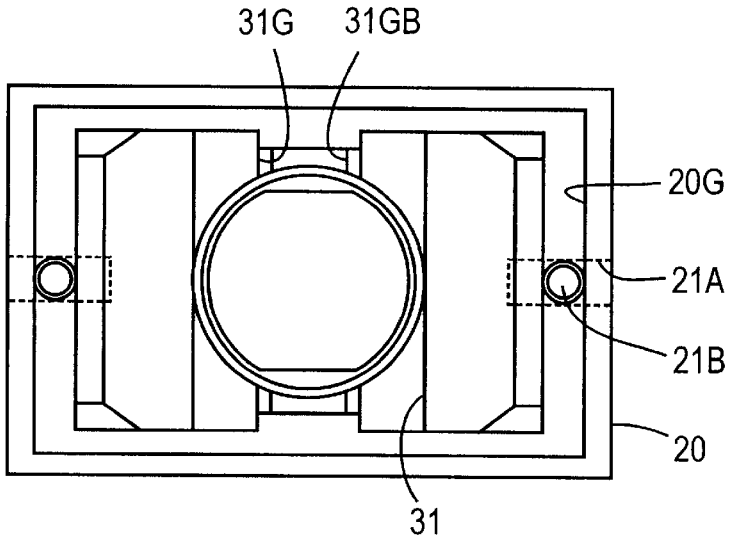
FIG. 14C is a bottom view of the cover 20.

As shown in a plan view, a side view partly in cross-section, and a bottom view, respectively, in FIGS. 14A, 14B and 14C, respectively, the metallic cover 20 having a generally rectangular top surface has a cylindrical rotator holding section 30 form integrally with and extending upwardly from its top surface in the center thereof and defining a rotator housing cavity 31 therein. The rotator housing cavity 31 is formed in its peripheral wall with guide recesses 31G for guiding the rotary studs 47 (see FIGS. 9 and 10) of the actuator 40. The guide recesses 31G terminate in upper bearing recesses 31GB having a reduced width.

In this second embodiment as well, the coil spring 45 and the driving piece 46 are mounted in the actuator 40 with the sliding protrusions $46_1$, $46_2$ of the driving piece 46 held in pressure contact with the upper surface of the movable contact blade 50 and with the rotary studs 47 of the actuator 40 resting on the top end faces of the corresponding posts 11C. In this state, the cover 20 with its rotator holding section 30 is inserted over the actuator 40 from its per end. In doing this, the rotary studs 47 and the posts 11C are guided by the guide recesses 31G into the rotator housing cavity 31 while the rotary studs 47 are further moved into the bearing recesses 31GB and positioned in place and supported by the top end faces of the posts 11C. At the same time, the upper portions of the side walls 11 of the case 10 are embraced in frame-like grooves 20G formed in the undersurface of the cover 20 while the engagement positioning pins 11PN are inserted in corresponding engagement holes 21B of the cover 20. In this state, pins 11P are press-fitted in aligned pin receiving holes 21A and 11A formed through the side walls of the cover 20 and the case 10, respectively to fix the cover 20 in place.

The rotator holding section 30 has a ring groove 30G formed in the outer periphery adjacent the top end thereof and likewise the actuator 40 has a ring groove 40G formed in the outer periphery thereof protruding out from the rotator holding section 30. A tubular rubber cap 80 has thickened ring portions 80A and 80B adjacent its opposite ends. The rubber cap 80 is fitted over the actuator 40 with one end thickened ring portion 80A engaged in the ring groove 30G of the rotator holding section 30 and with the other end thickened ring portion 80B engaged in the ring groove 40G of the actuator 40. This prevents the ingress of dust, water and the like through the gaps between the rotator holding section 30 and the actuator 40.

As can be appreciated from the foregoing, since the cover 20 and the rotator holding section 30 are integrated together and the plunger and the driving piece 46 are combined in function, the second embodiment requires a less number of component parts than the first embodiment even if the waterproof cap 80 is used, and yet is superior in resistance to dust and water.

Figure 15:
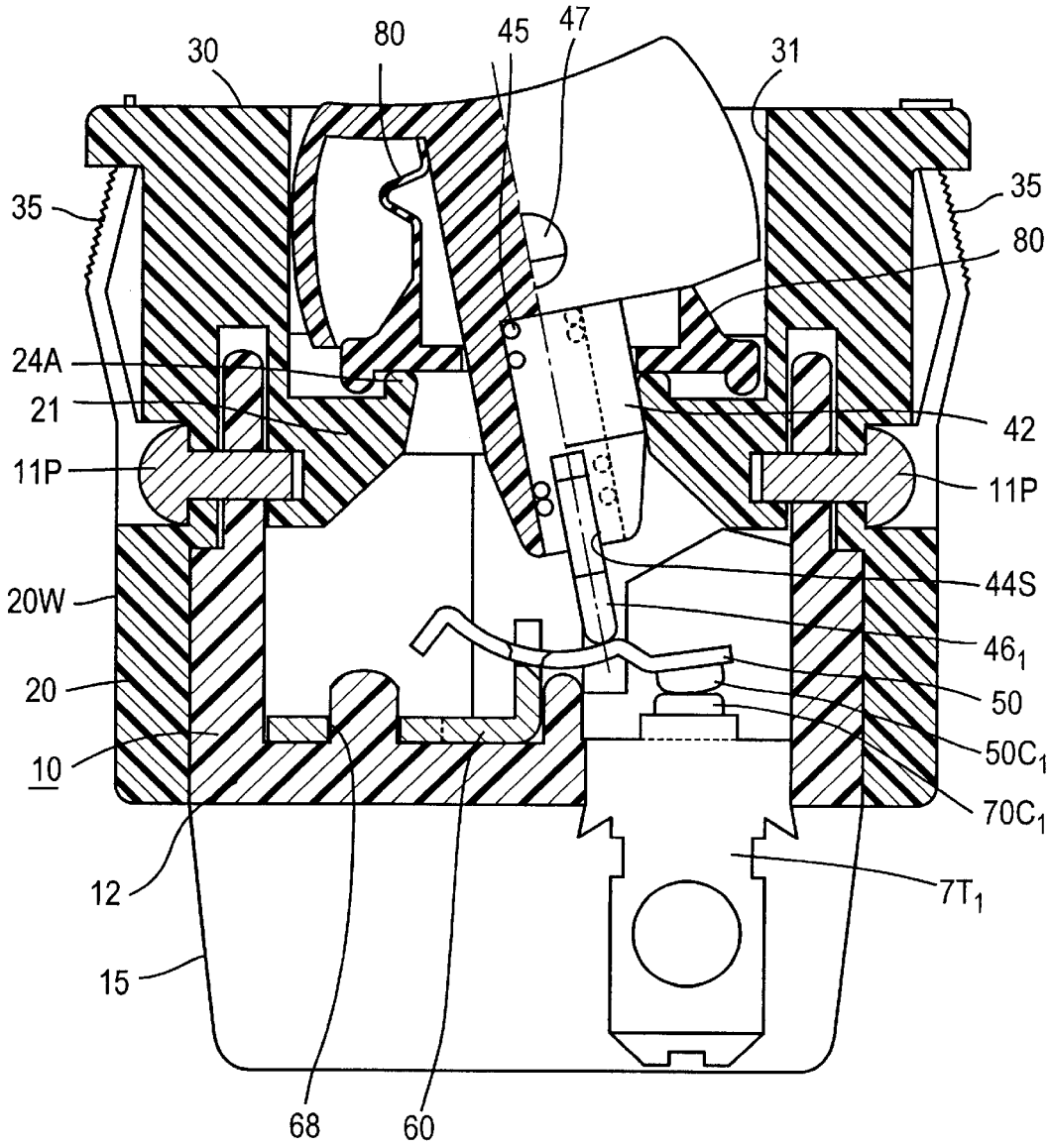
FIG. 15 is a vertical cross-sectional view of a third embodiment of the switch according to this invention taken parallel to the major side of the switch.
Figure 16:
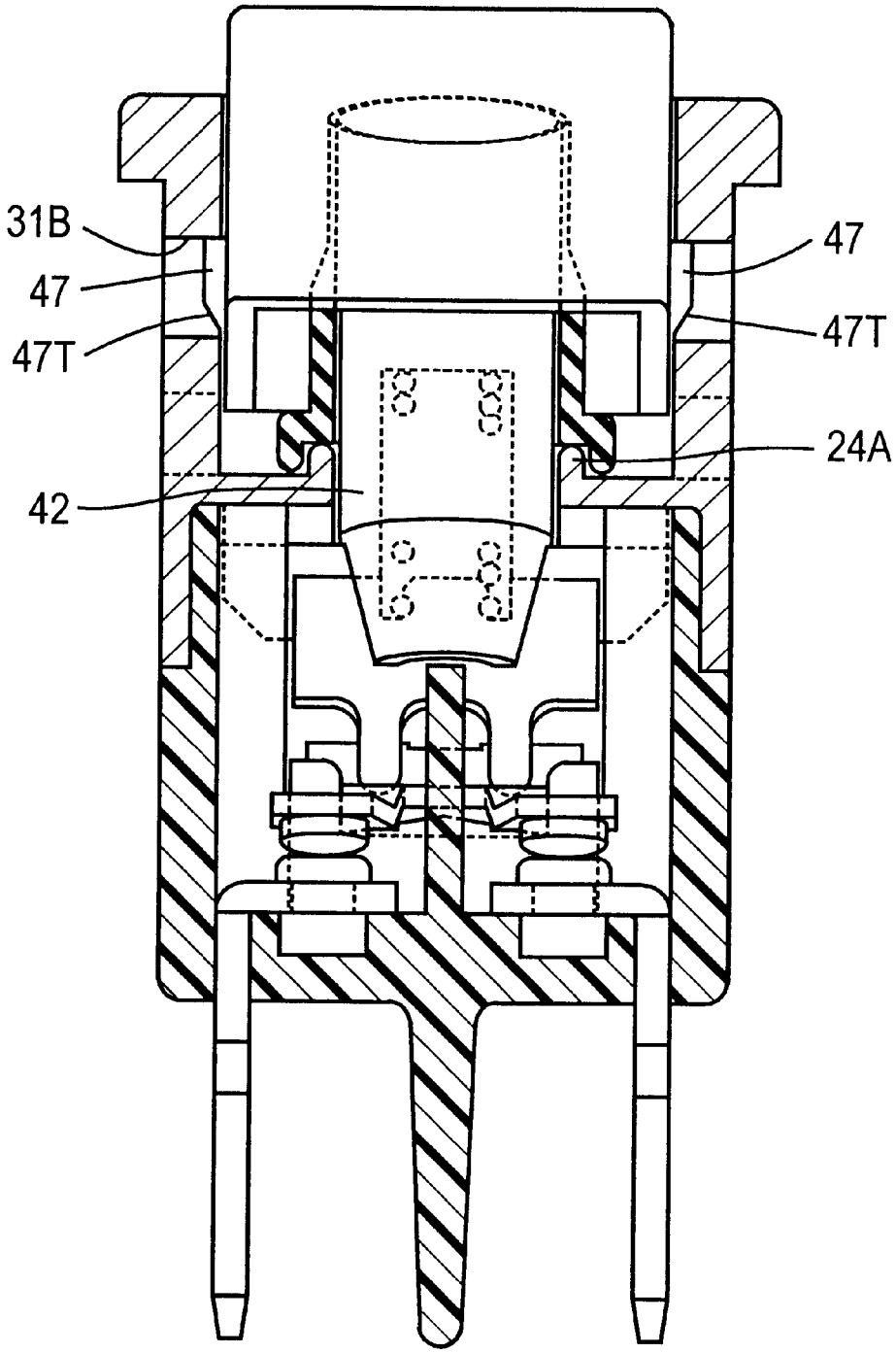
FIG. 16 is a vertical cross-sectional view of the third embodiment taken parallel to the minor side of the switch.

Third Embodiment:

FIGS. 15 and 16 show the switch according to a third embodiment of this invention in a vertical cross-sectional view taken parallel to the major side of the switch and a vertical cross-sectional view taken perpendicularly to the major side, respectively. Again applied to this embodiment is the principle of this invention illustrated in FIGS. 2A, 2B. The constructions of the box-like case 10 and the fixed contact blades $70_1$, $70_2$ disposed on its bottom panel 12 and of the support plate 60 and the movable contact blade 50 mounted on the support plate 60 in this third embodiment are similar to those in the second embodiment, except that the posts 11C do not protrude upwardly beyond the side walls 11.

The main differences are that that the handle portion 41 is of a tumbler type, that the rotary studs 47 of the actuator 40 are rotatably supported in bearing holes 31B formed in the side walls of the rotator holding section 30 which doubles as a switch mounting portion, and that dustproof and waterproof structure is provided in the interior of the rotator housing cavity 31. In this embodiment, the switch mounting portion by which the switch is attached to a device has obtusely angular leaf springs 35 extending outwardly from its opposed side walls. The leaf springs 35 are adapted to be snapped into mounting holes (not shown) formed in the chassis of the device to which the switch is to be attached.

Figure 17A:
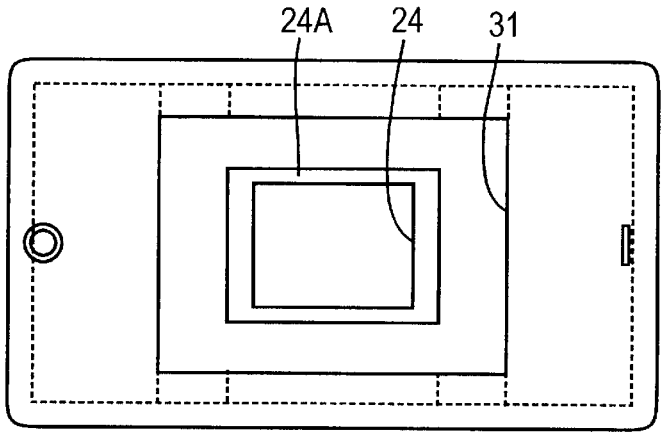
FIG. 17A is a plan view of the cover 20.
Figure 17B:
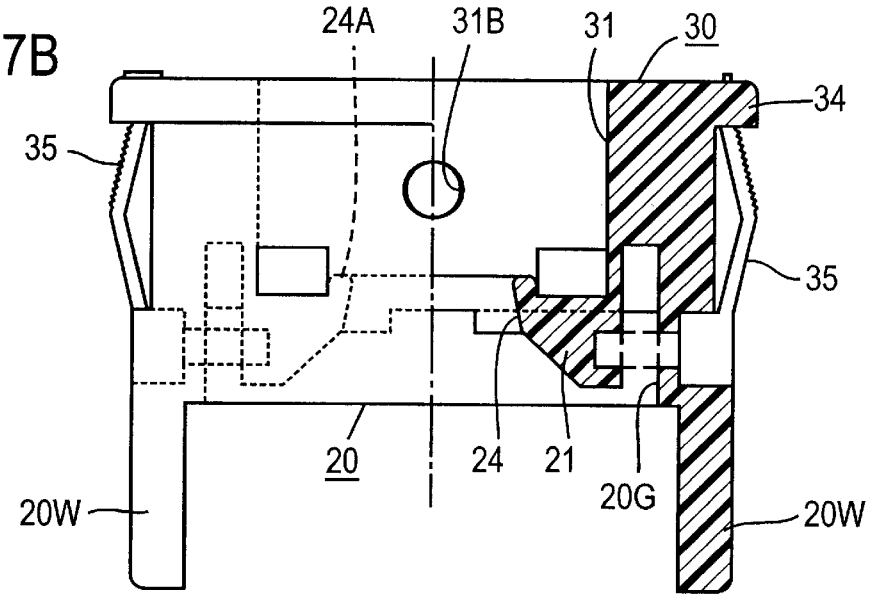
FIG. 17B is a side view, partly in cross-section, of the cover 20.
Figure 17C:
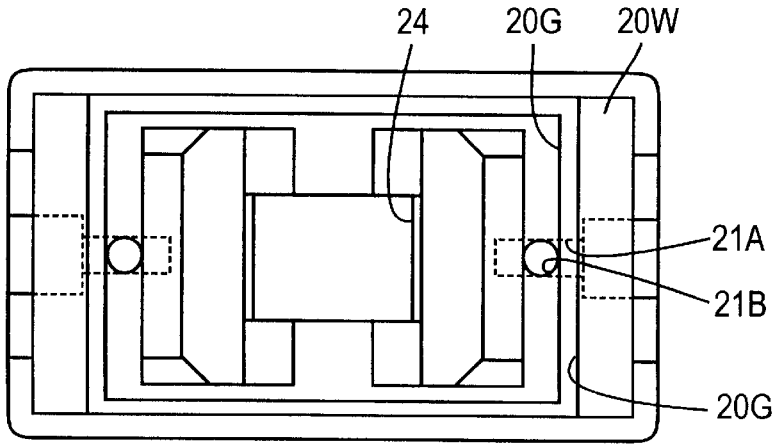
FIG. 17C is a bottom view of the cover 20.

As shown in FIGS. 17A, 17B and 17C, the cover 20 includes a top panel section 21 having a rectangular communication aperture 24 formed therethrough in the center which is surrounded by a peripheral raised rim 24A. The cover also includes opposed skirts 20W formed integrally with and depending downwardly from the lower ends of the opposite minor sides of the top panel section so as to cover the minor side walls of the case 10. The cover 20 has frame-like mating grooves 20G formed in its undersurface for receiving the upper end portions of the side walls of the case 10. The cover 20 further includes an integrally formed rotator holding section 30 defined by side walls extending upwardly from the four sides of the quadrilateral top panel section 21. The rotator holding section 30 defines a rotator housing cavity 31 therein. The rotator holding section 30 have bearing holes 3lB formed through the opposite major side walls thereof and flanges 34 outwardly projecting from the upper ends of the four walls thereof.

In this embodiment, as shown partly in cross-section in FIG. 15, the tumbler type handle portion 41 (which will be called tumbler hereinbelow) of the actuator 40 is in the shape of an inverted rectangular box having a concavely arcuate top wall and rotary studs 47 formed integrally with the opposite walls. The rotary studs 47 are progressively reduced in thickness toward their outer ends so as to define tapered surfaces 47T on their undersides. When the actuator 40 is inserted in the rotator housing cavity 31, the tapered surfaces 47T aid in the actuator resiliently expanding the two opposed side walls formed with the bearing holes 31B outwardly apart from each other until the rotary studs 47 are fitted in the bearing holes 31B whereupon the opposed side walls of the cavity 31 are restored to their original position and the actuator 40 is rotatably supported between the opposed side walls.

Extending from the inner ceiling wall of the box-like handle portion 41 in the center thereof is a columnar portion 42 which has, as in the second embodiment, a spring housing bore 42A and a slide slot 44S formed in the lower end portion thereof. The spring housing bore 42A extends upwardly from the forward end of the columnar portion in the center thereof concentrically with the central axis thereof while the slide slot 44S intersects the bore 42A diametrically thereof and extends upwardly from the forward end of the columnar portion along the central axis thereof.

Figure 18A:
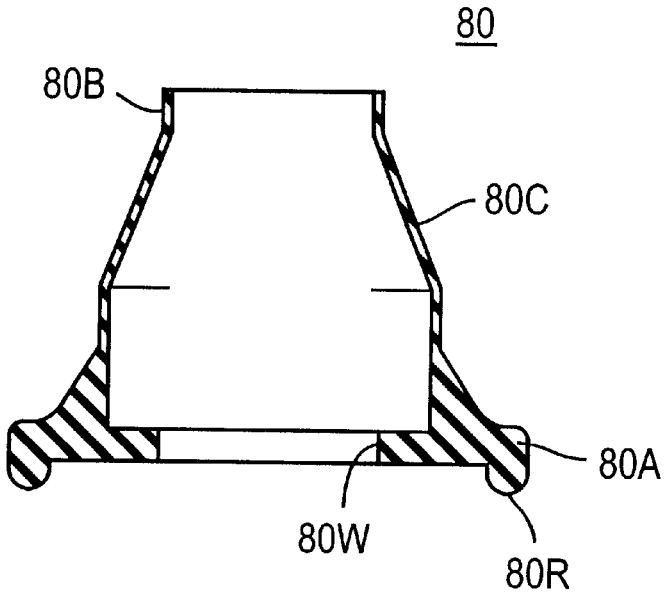
FIG. 18A is a vertical cross-sectional view of the waterproof cap 80 taken parallel to the major side thereof.
Figure 18B:
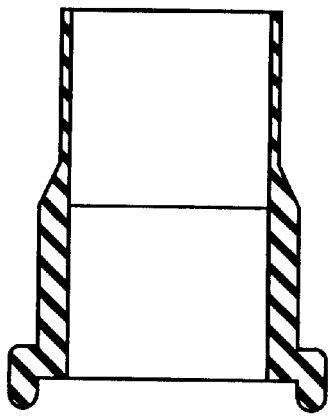
FIG. 18B is a vertical cross-sectional view of the waterproof cap 80 taken parallel to the minor side thereof.

The waterproof rubber cap 80 comprises a rectangular thick-walled base plate portion 80A at its lower end, a ring portion 80B at its upper end and a pliant thin-walled sleeve portion 80C extending between the base plate portion 80A and the ring portion 80B. The base plate portion 80A has a square window 80W formed therethrough and adapted to align with the communication aperture 24 of the cover 20. As shown in a vertical cross-sectional view taken parallel to the major side of the cap and in a vertical cross-sectional view taken parallel to the minor side in FIGS. 18A and 18B, respectively, the sleeve portion 80C has its major sides progressively decreasing as it extends upwardly from the base plate portion 80A so as to describe a circle in cross-section. The diameter of the ring portion 80B at the upper end is sized such that the inner periphery of the ring portion may resiliently contact closely with the outer peripheral surface of the columnar portion 42. The base plate portion 80A has a frame-like ridge 80R depending downwardly from its outer periphery which is adapted to surround the rim 24A (see FIG. 17A) of the rectangular communication aperture 24 in the cover 20 and closely contact the upper surface of the cover 20 (see FIG. 15) to thereby prevent the ingress of dust and water through between the columnar portion 42 and the opening 24.

When assembling the switch, the waterproof cap 80 is preliminarily mounted over the columnar portion 42 within the tumbler 41, the coil spring 45 having the driving piece 46 connected at its lower end is mounted in the spring housing bore 42A, and the columnar portion 42 together with the driving piece 46 is inserted through the rotator housing cavity 31 and the opening 24 into the case 10. At this time, the sliding protrusions $\mathbf{46}_1$, $\mathbf{46}_2$ of the driving piece 46 are brought into pressure contact with the upper surface of the movable contact blade 50. The actuator 40 is inserted and press-fitted from above into the rotator housing cavity 31 until the rotary studs 47 are fitted in the bearing holes, whereby the assembly of the switch is completed.

Figure 19:
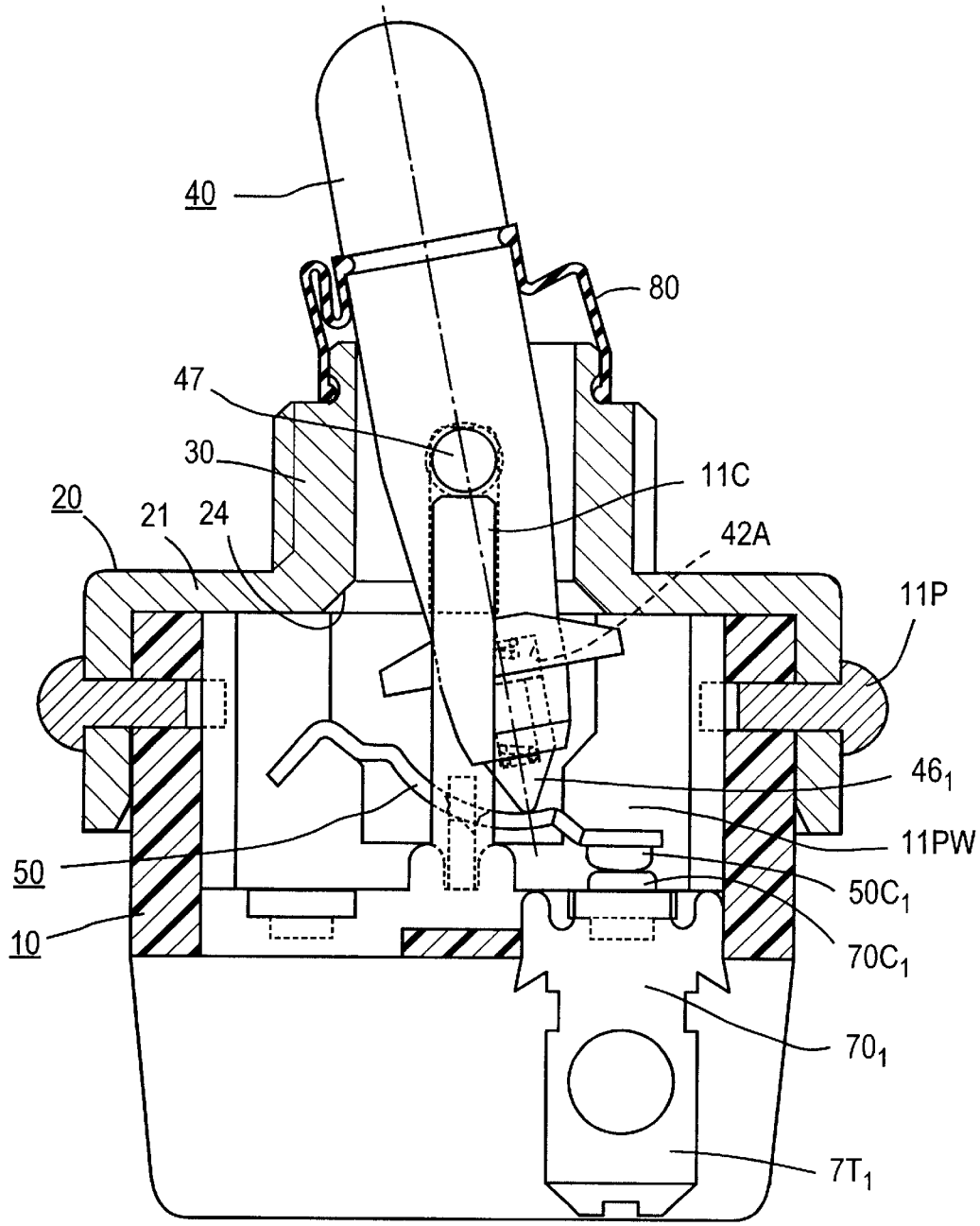
FIG. 19 is a vertical cross-sectional view of a fourth embodiment of the switch according to this invention taken parallel to the major side of the switch.
Figure 20:
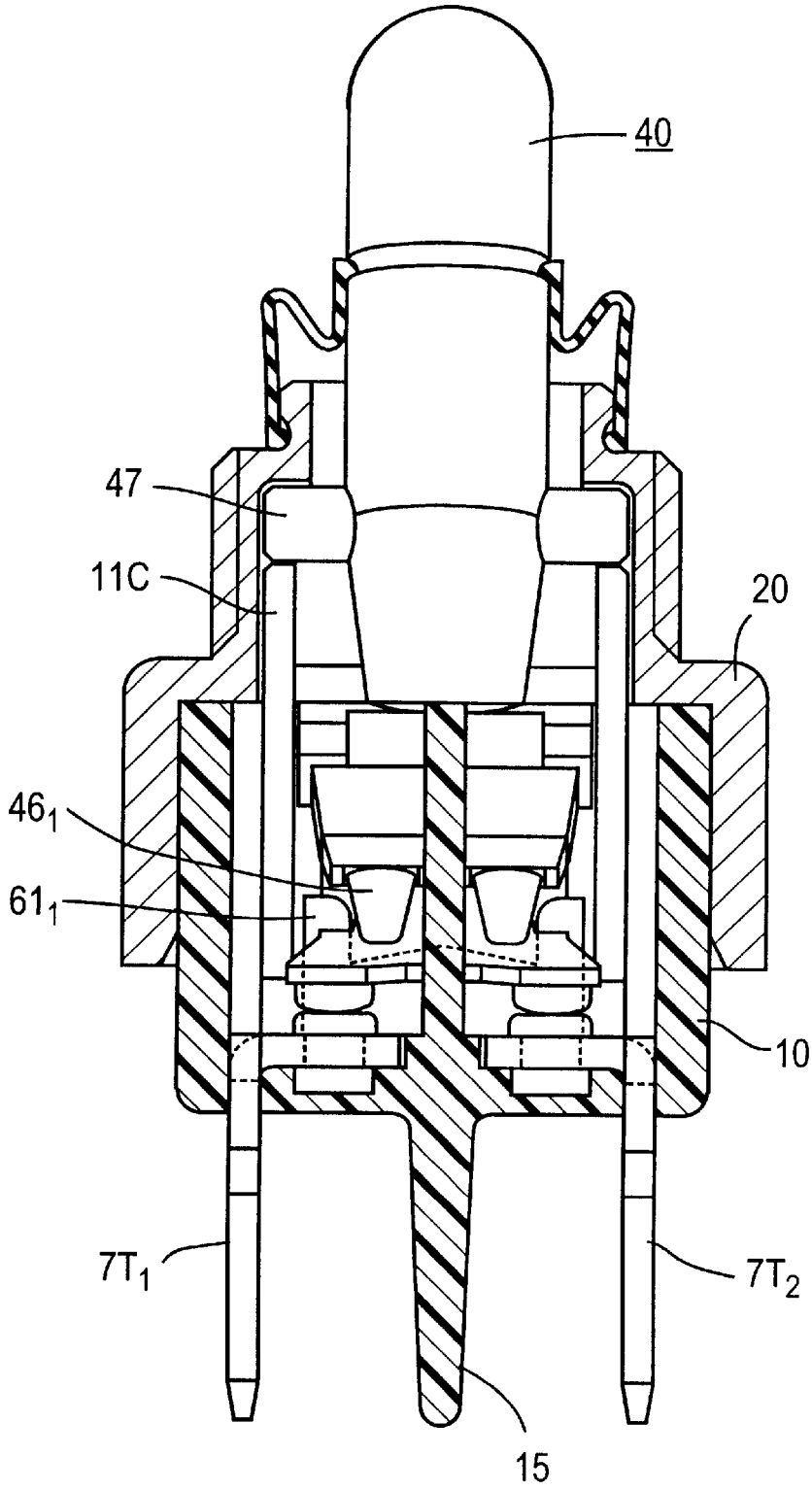
FIG. 20 is a vertical cross-sectional view of the fourth embodiment taken parallel to the minor side of the switch.
Figure 21:
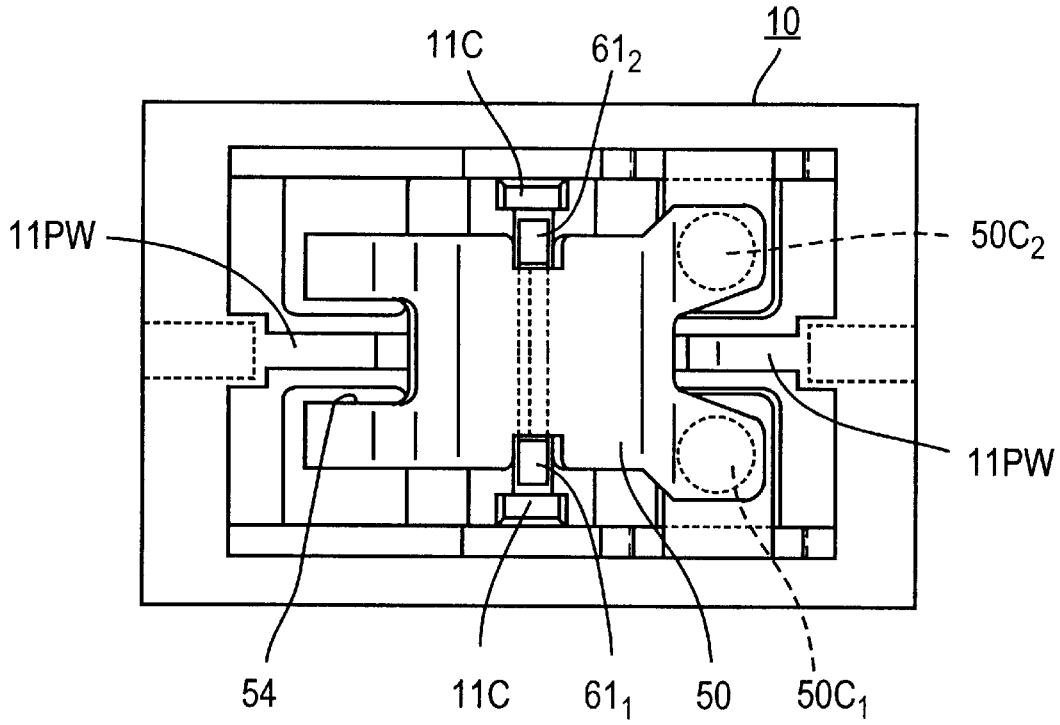
FIG. 21 is a plan view of the fourth embodiment with the cover removed therefrom.

Fourth Embodiment:

FIGS. 19, 20 and 21 show the switch according to a fourth embodiment of this invention in a vertical cross-sectional view taken parallel to the major side of the switch, in a vertical cross-sectional view taken parallel to the minor side and in a plan view, respectively. This embodiment is characterized in that the sliding protrusions $\mathbf{46}_1$, $\mathbf{46}_2$ which are integrated with the driving piece 46 in the second embodiment of FIGS. 9, 10 and 11 are formed separately from the driving piece.

Figure 22A:
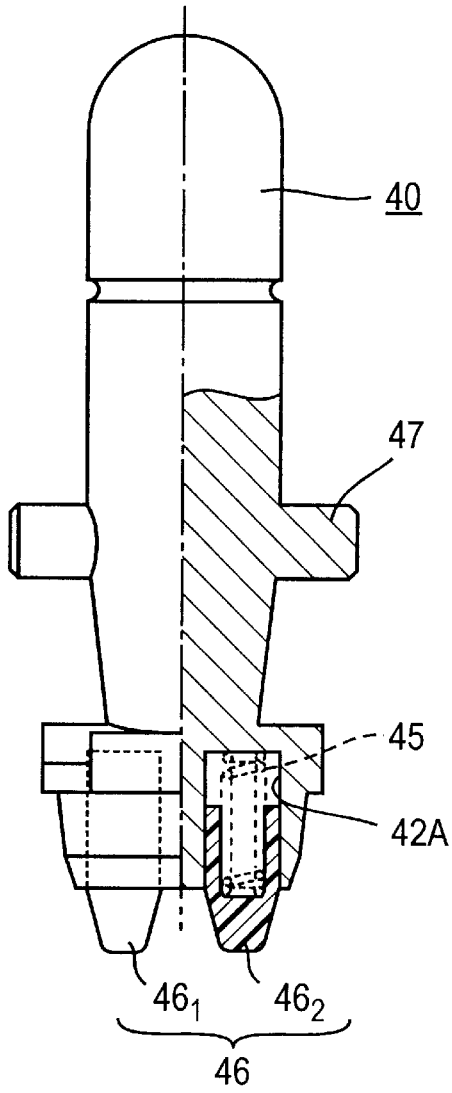
FIG. 22A is a side view, partly in cross-section, of the actuator used in the fourth embodiment.
Figure 22B:
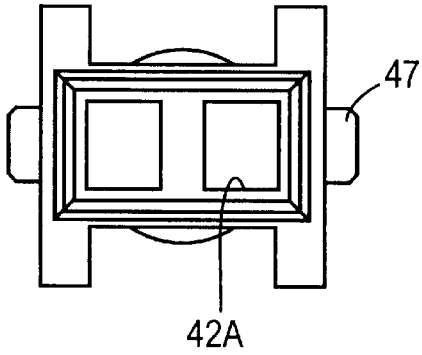
FIG. 22B is a bottom view of the actuator of FIG. 22A.

In this embodiment, the actuator 40 is formed in its lower end portion with two spring housing bores 42A juxtaposed axially of the rotary studs 47 and extending parallel to the central axis of the actuator 40, as shown in FIGS. 22A, 22B. Mounted in these spring housing bores 42A are two respective cylindrical sliding protrusions $\mathbf{46}_1$, $\mathbf{46}_2$ closed at their lower ends and having respective coil springs 45 accommodated therein. The cylindrical sliding protrusions $\mathbf{46}_1$, $\mathbf{46}_2$ with the coil springs 45 accommodated therein are mounted for sliding movement in the spring housing bores 42A. The coil springs 45 protrude upwardly out of the sliding protrusions $\mathbf{46}_1$, $\mathbf{46}_2$ into abutment with the ceiling of the spring housing bores 42A so as to urge the sliding protrusions $\mathbf{46}_1$, $\mathbf{46}_2$ downwardly to thereby press the lower ends of the sliding protrusions $\mathbf{46}_1$, $\mathbf{46}_2$ onto the upper surface of the movable contact blade 50.

The rest of the construction is generally similar to that shown in FIG. 9. With this construction, the two sliding protrusions $\mathbf{46}_1$, $\mathbf{46}_2$ press down on and slide on the upper surface of the movable contact blade 50 with substantially equal pressures. It is to be appreciated that this construction of the driving piece 46 may be applied to the other embodiment.

Figure 23:
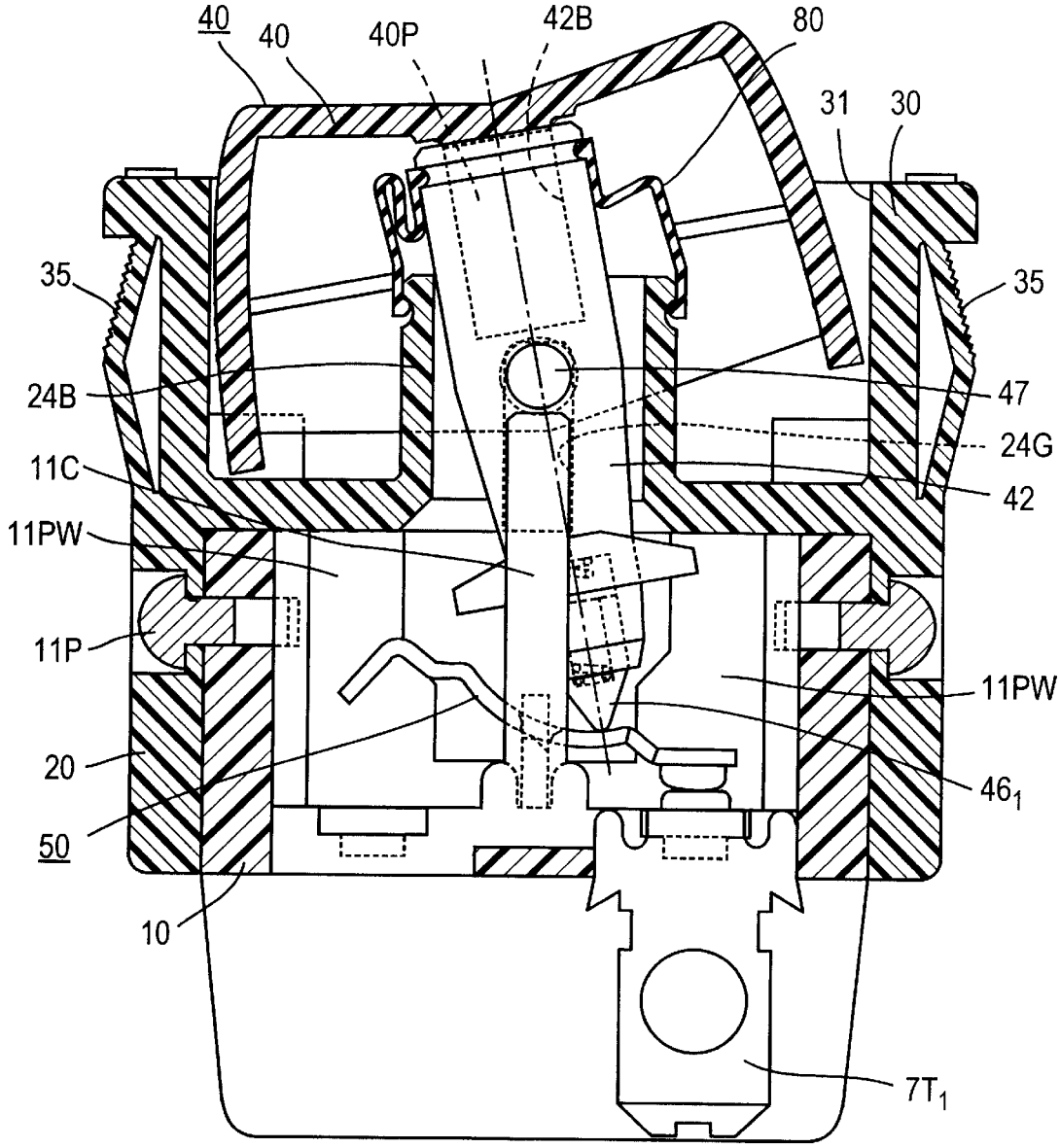
FIG. 23 is a vertical cross-sectional view of a fifth embodiment of the switch according to this invention taken parallel to the major side of the switch.
Figure 24:
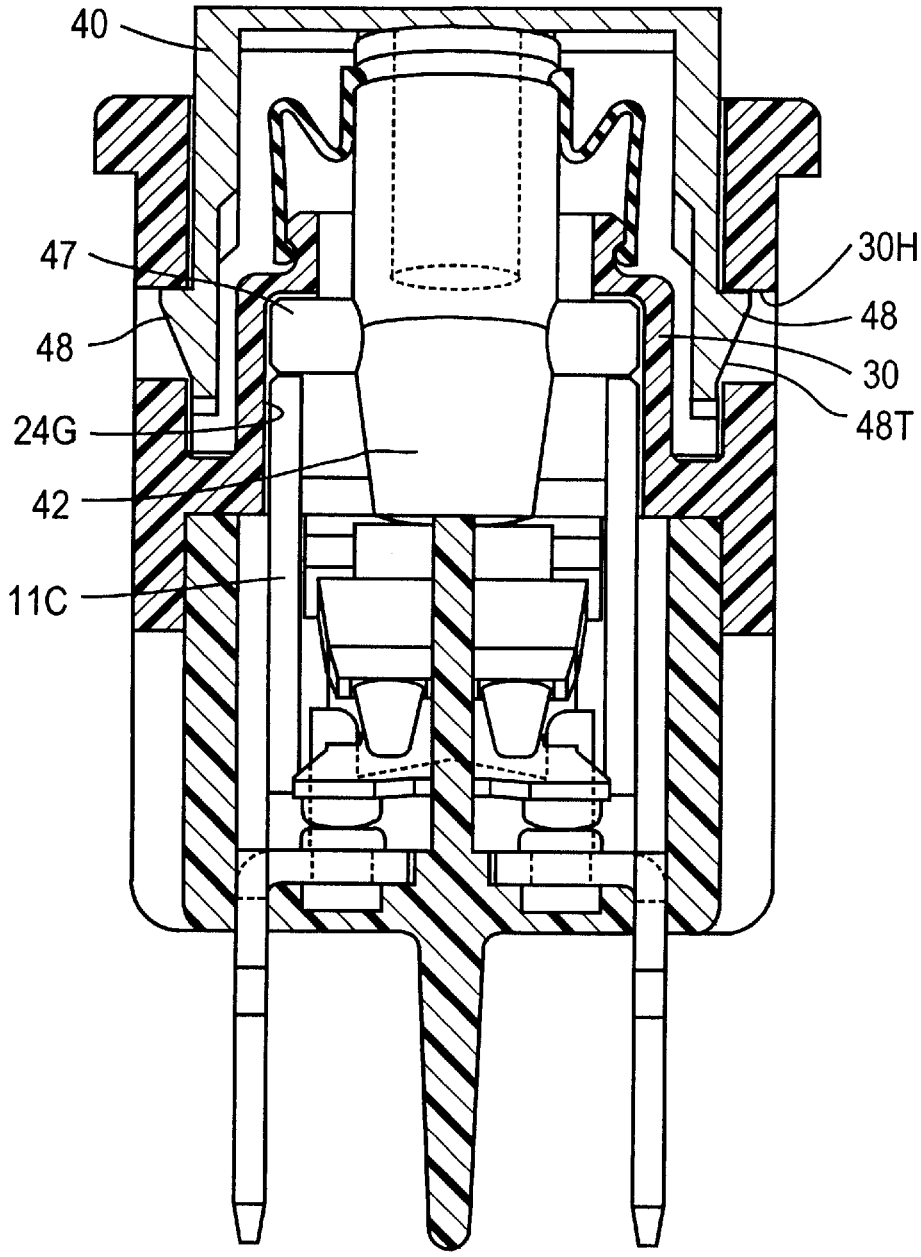
FIG. 24 is a vertical cross-sectional view of the fifth embodiment taken parallel to the minor side of the switch.

Fifth Embodiment:

FIGS. 23 and 24 show a fifth embodiment which is similar to the embodiment of FIGS. 15 and 16 but to which an actuator 40 having a driving piece 46 as shown in FIGS. 19 and 20 is applied. In this embodiment, a switch mounting portion 30 and a rotator holding section 24B are separately formed on the cover 20. The cylindrical portion 42 of the actuator 40 is formed in its center with rotary studs 47 extending oppositely from each other perpendicularly to the central axis of the actuator 40. The rotator holding section 24B is formed on the upper surface of the top panel section 21 by extending the rim 24A around the communication aperture 24 shown in FIGS. 15 and 16 upwardly. The opposed inner walls of the rotator holding section 24B which are parallel to the major side of the case 10 have guide recesses 24G formed therein for receiving the rotary studs 47 and guiding the posts 11C like the guide recesses 31G described before with respect to FIG. 14B. The rotary studs 47 are rotatably supported on the tip ends of the posts 11C in the uppermost portions of the guide recesses 24G.

The tumbler type handle portion 41 has a mounting pin 40P formed integrally with its inner ceiling wall in the center thereof and has round protrusions 48 extending from the opposed side walls thereof concentrically with the rotary studs 47. The round protrusions 48 have lower tapered surfaces 48T so as to be reduced in thickness to approximately zero at outer ends. The cover 20 has a mounting portion 30 formed by extending the outer peripheral wall of the cover 20 in FIG. 19 upwardly. The tumbler type handle portion 41 is mounted in a rotator housing cavity 31 defined therein. When this is done, the tumbler 41 is depressed so that the mounting pin 40P is fitted in a mounting hole 42B formed in the upper end portion of the actuator 40 whereby the tapered surfaces 48T of the round engagement protrusions 48 of the tumbler 41 resiliently force the opposed side walls of the mounting portion 30 apart to allow the tumbler 41 to move into the cavity 31 while the engagement protrusions 48 are rotatably fitted in holes 30H in the mounting portion 30. This prevents withdrawal of the tumbler 41 from the rotator housing cavity 31.

This mounting of the tumbler 41 is carried out by first placing the cover 20 over the case 10 from above while guiding the rotary studs 47 and the posts 11C into the guide recesses 24G formed in the inner walls of the rotator holding section 24B, with the sliding protrusions $\mathbf{46}_1$, $\mathbf{46}_2$ of the actuator 40 in pressing engagement on the upper surface of the movable contact blade 50 and with the rotary studs 47 of the actuator 40 resting on the top ends of the posts 11C, followed by covering the outer periphery of the upper end portion of the cylindrical portion 42 and the outer periphery of the upper end portion of the tubular rotator holding section 24B with a waterproof cap 80 so as to connect them together, pushing the tumbler 41 into the rotator housing cavity 31 while inserting the mounting pin 40P of the tumbler 41 into the mounting hole 42B, and snapping the engagement protrusions 48 into the engagement holes 30H.

Figure 25:
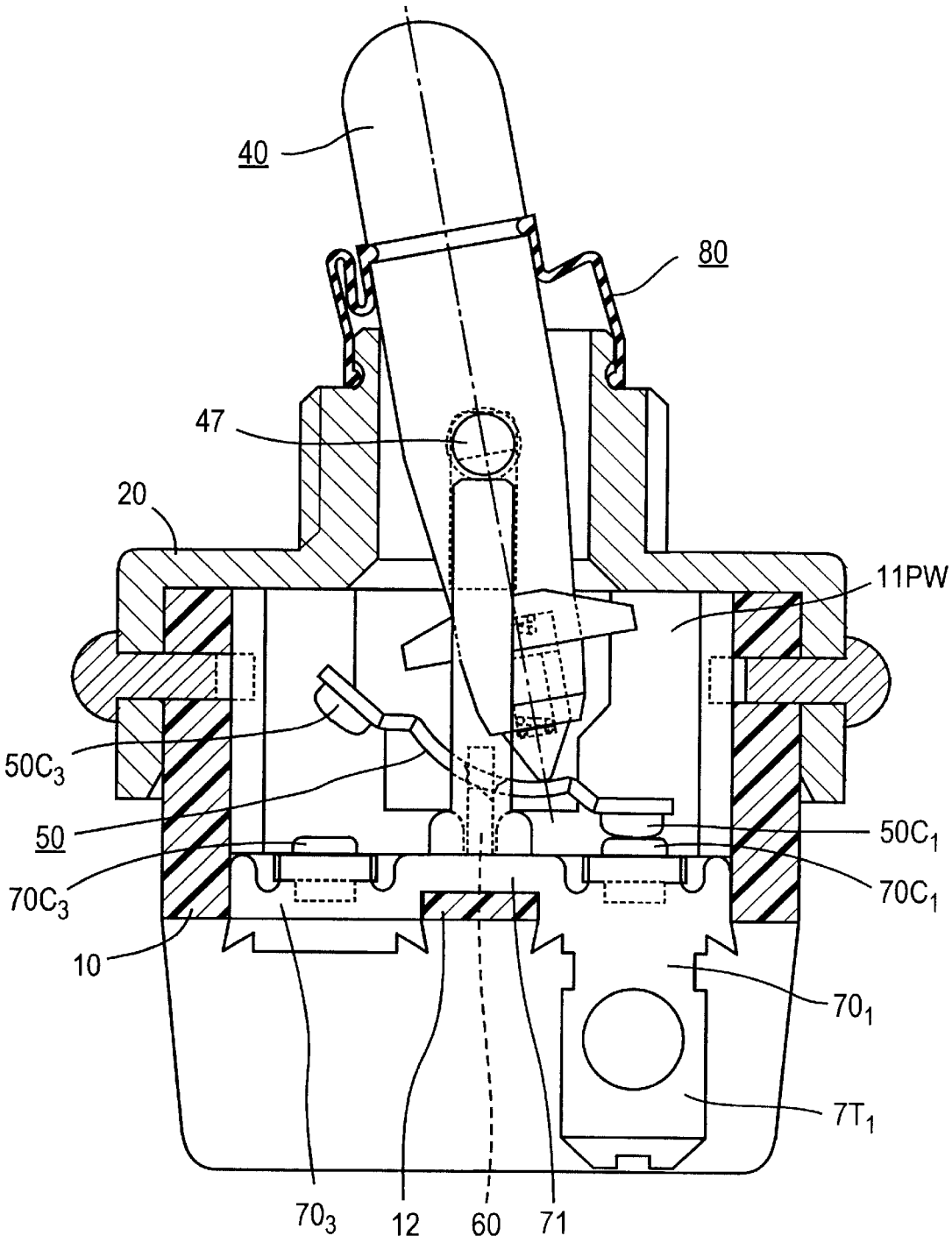
FIG. 25 is a vertical cross-sectional view of a sixth embodiment of the switch according to this invention taken parallel to the major side of the switch.
Figure 26:
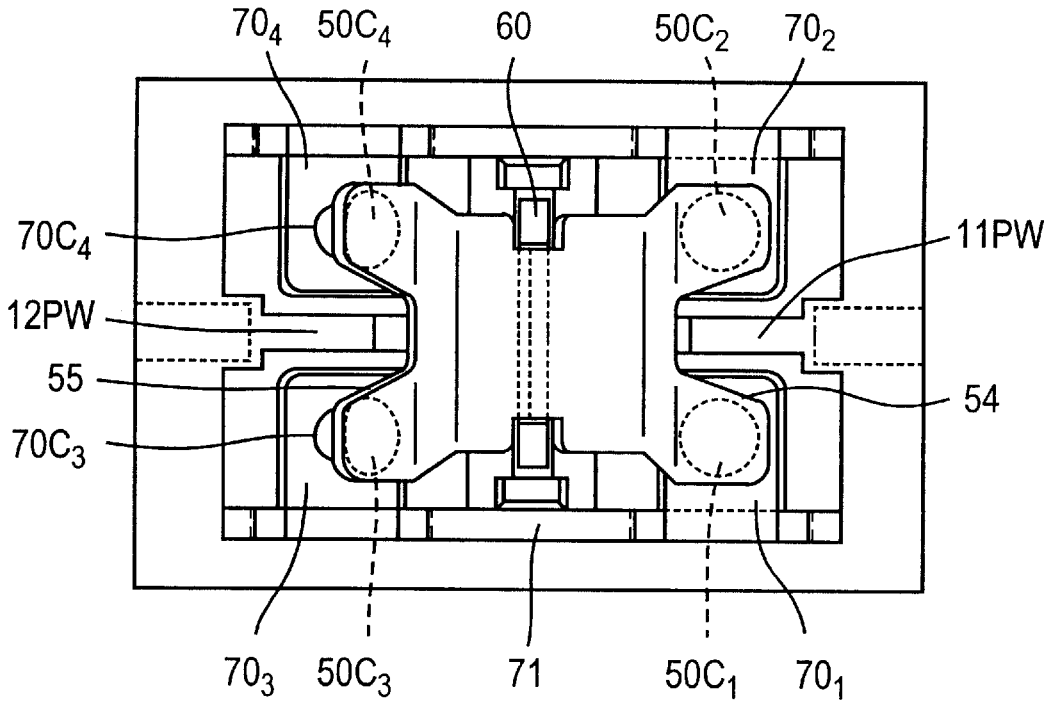
FIG. 26 is a plan view of the sixth embodiment with the cover removed therefrom.

Sixth Embodiment:

FIG. 25 illustrates a fifth embodiment which is similar in construction to that of FIG. 19 but in which two circuit switches are formed. FIG. 25 is a vertical cross-sectional view of the switch taken parallel to the major side of the switch, and FIG. 26 is a plan view showing the switch seen from above the case 10 with the cover 20 removed therefrom. As shown in FIGS. 25 and 26, additional movable contacts $\mathbf{50}C_3$, $\mathbf{50}C_4$ are provided on the movable contact blade 50 at opposite corners on the side of the support plate 60 opposite from the movable contacts $\mathbf{50}C_1$, $\mathbf{50}C_2$, and additional fixed contact blades $\mathbf{70}_3$ and $\mathbf{70}_4$ having additional fixed contacts $\mathbf{70}C_3$ and $\mathbf{70}C_4$ attached thereon in opposition to the corresponding movable contacts $\mathbf{50}C_3$ and $\mathbf{50}C_4$, respectively are affixed to the bottom panel 12.

This embodiment illustrates an instance where the fixed contact blades $\mathbf{70}_1$ and $\mathbf{70}_3$ are formed in a one-piece construction connected by a connecting portion 71 with the terminal $\mathbf{7}T_1$ functioning electrically as a common terminal for the two fixed contact blades $\mathbf{70}_1$ and $\mathbf{70}_3$ the latter of which is devoid of a terminal. Thus in this embodiment, one switching circuit is defined between the terminals $\mathbf{7}T_1$ and $7T_2$ and another switching circuit is defined between the terminals $7T_3$ and $7T_4$, with the terminal $7T_1$ functioning electrically as a common terminal for the two circuits. It is of course to be appreciated that the switching circuits may be electrically separated from each other by eliminating the connecting portion 71 and providing the fixed contact blade $70_3$ with its own terminal $7T_3$ (not shown).

Further, in this embodiment, the movable contact blade 50 has a cutout 55 formed extending from the center of the side edge thereof between the movable contacts $50C_3$ and $50C_4$, as shown in FIG. 26. A partition wall 12PW extending inwardly from the corresponding minor side wall of the case 10 is inserted loosely in the cutout 55 without contacting the surrounding wall of the cutout 55 to thereby increase the creeping distance between the fixed contacts $70C_3$ and $70C_4$.

Figure 27:
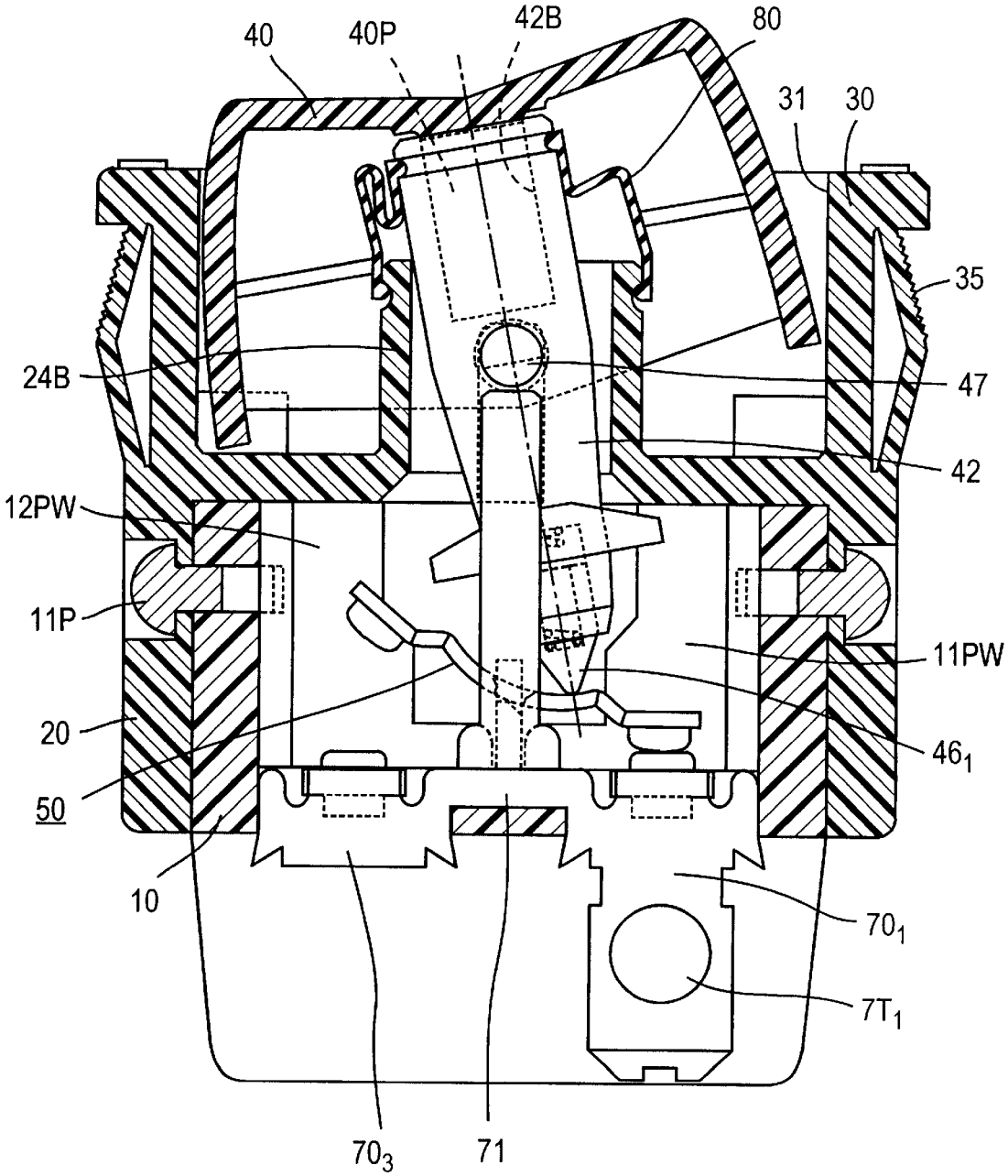
FIG. 27 is a vertical cross-sectional view of a seventh embodiment of the switch according to this invention taken parallel to the major side of the switch.

Seventh Embodiment:

A seventh embodiment shown in FIG. 27 illustrates an instance which is similar in construction to that of FIG. 23 but in which two switching circuits are formed like the embodiment of FIG. 25. Further description is omitted for purposes of convenience. As will be appreciated, two switching circuits may be provided in any of the embodiments described above.

In the first, second and third embodiments as described hereinabove, it is to be understood that the movable contact blade 50 may be slightly bent as shown in FIG. 3 such that the slide surface of the blade is downwardly convexed in the sliding direction of the sliding protrusions $46_1$, $46_2$ or may be made concave as shown in FIGS. 9, 15, 19, 23, 25 and 27, whereby the range of rotation of the plunger 43 (or the driving piece 46) may be increased as compared to a flat-plate type movable contact blade, so that the spacing distance between the movable contacts $50C_1$, $50C_2$ and the fixed contacts $70C_1$, $70C_2$ or between the movable contacts $50C_3$, $50C_4$ and the fixed contacts $70C_3$, $70C_4$ in the switch-off state may be correspondingly increased, leading to raising the voltage at which abnormal discharge may start during the switch-off state. Hence, a switch with a high withstandingness to voltage may be realized.

Effects of the Invention:

As explained above, two serial switches are constituted between two movable contacts $50C_1$, $50C_2$ and two associated fixed contacts $70C_1$, $70C_2$, and the movable contact blade 50 which is supported at substantially one point is rotated by sliding two sliding protrusions $46_1$, $46_2$ across the upper surface of the blade 50 with the protrusions in pressure contact with the surface, whereby the two serially connected switches may be simultaneously turned on and off. Consequently, the withstandingness to voltage of the entire switch may be doubled as compared to the prior art switch, and additionally, assuming that the distance of travel per unit time, that is, speed of each of the movable contacts $50C_1$, and $50C_2$ during the switch-off operation is d cm/sec, the sum of the distances of travel per unit time by the two contacts would be 2d cm/sec, whereby the time required for the discharge arch to extinguish would be reduced to half or shorter. As a result, the wearing out of the contacts $50C_1$, $50C_2$ and $70C_1$, $70C_2$ may also be reduced.

What is claimed is:

1. A switch comprising:

a case having a bottom panel of an insulator and an opening in the top thereof;

a support plate secured to and extending vertically upwardly from said bottom panel and terminating in a top end edge defining a central convex portion which is the highest in the center thereof;

a movable contact blade formed of a metallic plate supported on said top end edge of said support plate for rotating movement about the top end edge defining a pivot axis and having attached thereon two movable contacts spaced apart in the direction of the pivot axis adjacent one end of the movable contact blade;

two fixed contact blades affixed at one end to the bottom panel and each having a fixed contact attached thereto adjacent said one end in opposition to a corresponding one of the movable contacts with said other end portion of each fixed contact blade extending out through said bottom panel to define a terminal;

a driving means having two sliding protrusions pressing on the upper surface of said movable contact blade and slidable in a direction perpendicular to the direction of said pivot axis;

coil spring means having a biasing force to urge said driving means toward said movable contact blade;

a rotatable actuator having a spring housing bore formed in the lower end portion in which the coil spring means is accommodated and including a columnar portion that holds said driving means retractably in abutment with said movable contact blade as said driving means is slidingly moved on said movable contact blade; and a cover means mounted so as to close the top opening of the case and having an aperture formed therethrough in the center thereof for rotatably holding said actuator which is inserted through said aperture;

whereby rotation of said actuator selectively establishes and break electrical continuity between said terminals between said two fixed contacts.

2. The switch set forth in claim 1, wherein said driving means includes a plunger having one end portion inserted extendably and retractably in the spring housing bore of said actuator and a driving piece attached to the other end of said plunger and having said two sliding protrusions.

3. The switch sot forth in claim 1, wherein said actuator has a slide slot formed in the lower end portion thereof and intersecting said spring housing bore diametrically thereof, said driving means being In the farm of a plate having its upper end portion slidably inserted in said slide slot in engagement with said coil spring moans and having said two sliding protrusions spaced apart from each other and extending from the lower end side of the plate.

4. The switch set forth in claim 1 wherein said two of said spring housing bore are formed in the lower end portion of said columnar portion extending parallel to the central axis of said columnar portion and juxtaposed in the direction of said pivot axis, said driving means comprising two cylindrical sliding protrusions closed at their lower ends and slidably mounted in the respective spring housing bores, said coil spring means having one end portions accommodated in the respective cylindrical sliding protrusions with the other ends of said coil spring means protruding upwardly out of the sliding protrusions into abutment with the ceiling of said spring housing bores so as to press the lower ends of the sliding protrusions onto said movable contact blade.

5. The switch set forth in claim 1 wherein said movable contact blade bus two additional movable contacts provided thereon adjacent the other end of the movable contact blade, said two additional movable contacts being spaced apart in the direction of the pivot axis and wherein two additional fixed contact blades having two additional fixed contacts attached thereon in opposition to the corresponding movable contacts are disposed on said bottom panel and affixed at one ends to said bottom panel with the other end portions of said additional fixed contact blades extending out through said bottom panel to define two additional terminals.

6. The switch set forth in claim 1 wherein said movable contact blade has two additional movable contacts provided thereon adjacent the other end of the movable contact blade, said two additional movable contacts being spaced apart in the direction of the pivot axis and wherein two additional fixed contact blades having two additional fixed contacts attached thereon in opposition to the corresponding movable contacts are disposed on said bottom panel, one of said two additional fixed contact blades being integrally connected with one of said two fixed contact blades and the other of said additional fixed contact blades extending out through said bottom panel to define an additional terminal.

7. The switch set forth in any one of claims 1, 2, 3, 4, 5 and 6 wherein said support plate has integrally firmed guide projections extending upwardly from the top end edge thereof at the opposite sides higher than said central convex portion, said movable contact blade having engagement recesses funned in the middle of the opposite sides thereof for engageably receiving the corresponding guide projections of said support plate whereby said movable contact blade is rotatably supported between said two guide projections.

8. The switch set forth in any one of claims 1, 2, 3, 4, 5 and 6 wherein said cover means includes a top panel section having said fanned therethrough in the center thereof for passing said actuator therethrough, a cover in the form of an inverted U in cross-section and having side panel sections extending downwardly from the opposite sides of said top panel section so as to cover at least the upper portions of the outer surfaces of the opposite side walls of said case, and a rotator holding section mounted on said cover and rotatably accommodating die rotatable central portion of said actuator, said actuator having a lever section extending upwardly beyond said rotator holding section.

9. The switch set forth in claim 8 including a waterproof rubber cap, said cap comprising a first ring portion resiliently contacting closely with the outer peripheral surface of said rotator holding section, a second ring portion resiliently contacting closely with the outer peripheral surface of said lever section outside of the rotator holding section, and a tubular portion connecting said first and second ring portions.

10. The switch set forth in any one of claims 1, 2, 3, 4, 5 and 6 wherein said actuator includes rotary studs formed on said pivot axis, said cover means including a top panel section placed over the opening of said case, side panel sections extending from the opposite sides of said top panel section so as to cover at least die upper portions of the opposite side walls of said case, and a cylindrical rotator holding section disposed on said top panel section and defining a rotator housing cavity therein in the inner wall of which bearing recesses for supporting said rotary studs are formed.

11. The switch set forth in any one of claims 1, 2, 3, 4, 5 and 6 wherein said movable contact blade has a cutout formed extending from the center of the one side thereof where said movable contacts are disposed and passing between said two movable contacts inwardly toward the other side, said case having a partition wall therein extending from the inner wall surface thereof into said cutout.

12. The switch set forth in any one of claims 1, 2, 3, 4, 5 and 6 wherein said actuator includes a tumbler in the shape of an inverted box and said columnar portion extending downwardly from the inner ceiling wall in the center thereof, said tumbler having rotary studs extending from its opposite side wails, said cover means having a communication aperture formed therethrough for rotatably receiving said columnar portion, a cover closing the opening of said case, and a rotator holding section disposed on said cover for rotatably accommodating said rotator holding section.

13. The switch set forth in claim 12 wherein said cover has an upwardly raised rim integrally formed on its upper suites so as to surround said communication aperture, and further including a waterproof rubber cap, said cap comprising a ring portion contacting closely with the outer peripheral surface of said columnar portion, a quadrilateral base plate portion surrounding the periphery of said rim and opposedly contacting the upper surface of said cover, and a tubular sleeve portion connecting said ring portion and said base plate portion.

14. The switch set forth in any one of claims 1, 2, 3, 4, 5 and 6 wherein said actuator includes:

a tumbler in the shape of an inverted box;

a mourning pin extending downwardly from the ceiling wall of said tumbler;

round engagement protrusions extending from the opposed side walls of said tumbler concentrically with said rotary studs; and said columnar portion having a mounting hole formed in die top end portion of said tumbler in which said mounting pin is fitted, said columnar portion having said rotary studs extending from the opposite side walls in the middle portion of the columnar portion perpendicularly to the central axis of thereof, and said columnar portion having said driving means provided in the lower end portion thereof; and said cover means includes:

a top panel closing the opening of said case and having said communication aperture formed therethrough in the center thereof for passing said columnar portion;

a rotator holding section extending in a tubular form upwardly from said top panel around said communication aperture for rotatably accommodating said rotator holding section; and side wall means extending upwardly from the outer periphery of said top panel so as to accommodate said tumbler and having engagement holes formed therethrough for engagement with the engagement protrusions of said tumbler.

15. The switch set forth in any one of claims 1, 2, 3, 4, 5 and 6 wherein said case has posts extending upwardly respectively from the opposed side walls of the case in the center thereof, said rotator holding section having guide grooves formed in the opposed inner walls thereof for guiding and rotatably holding said rotary studs and said posts on which said rotary studs are supported.

16. The switch set forth in claim 15 wherein said engagement protrusions are progressively reduced in thickness on the underside thereof so as to define tapered surfaces for engagement with said engagement holes.

17. The switch set forth in any one of claims 1, 2, 3, 4, 5 and 6 wherein the slide surface of said movable contact blade is in the form of a curved plate such that it is downwardly convexed in the sliding direction of said sliding protrusions.

* * * * *

UNITED STATES PATENT AND TRADEMARK OFFICE

CERTIFICATE OF CORRECTION

PATENT NO. : 6,559,393 B2
DATED : May 6, 2003
INVENTOR(S) : Kikuyoshi Nishikawa

It is certified that error appears in the above-identified patent and that said Letters Patent is hereby corrected as shown below:

Title page,
Item [73], Assignee, "Sagami Electric Company" should be -- Sagami Electric Co., Ltd. --

Signed and Sealed this

Twelfth Day of August, 2003

JAMES E. ROGAN
*Director of the United States Patent and Trademark Office*